US011307508B2

(12) United States Patent
Kusano et al.

(10) Patent No.: US 11,307,508 B2
(45) Date of Patent: Apr. 19, 2022

(54) ELECTROPHOTOGRAPHIC PHOTORECEPTOR, PROCESS CARTRIDGE, AND IMAGE FORMING APPARATUS

(71) Applicant: FUJIFILM Business Innovation Corp., Tokyo (JP)

(72) Inventors: Keisuke Kusano, Kanagawa (JP); Wataru Yamada, Kanagawa (JP); Masahiro Iwasaki, Kanagawa (JP); Yuto Okazaki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 70 days.

(21) Appl. No.: 16/913,619

(22) Filed: Jun. 26, 2020

(65) Prior Publication Data

US 2021/0302848 A1 Sep. 30, 2021

(30) Foreign Application Priority Data

Mar. 25, 2020 (JP) ..... JP2020-055093

(51) Int. Cl.

| | |
|---|---|
| ***G03G 5/147*** | (2006.01) |
| ***G03G 5/05*** | (2006.01) |
| ***G03G 15/01*** | (2006.01) |
| ***G03G 15/08*** | (2006.01) |
| ***G03G 21/00*** | (2006.01) |

(52) U.S. Cl.

CPC ..... *G03G 5/0539* (2013.01); *G03G 15/0131* (2013.01); *G03G 15/0868* (2013.01); *G03G 21/0017* (2013.01); *G03G 5/0532* (2013.01)

(58) Field of Classification Search

CPC ..... G03G 5/0539; G03G 5/14726

See application file for complete search history.

(56) References Cited

U.S. PATENT DOCUMENTS

| | | | | |
|---|---|---|---|---|
| 5,190,839 A * | 3/1993 | Fujimaki | C09B 3/00 430/72 |
| 10,705,441 B1 * | 7/2020 | Fujii | G03G 5/061473 |
| 2009/0226208 A1 * | 9/2009 | Nukada | G03G 5/0578 399/111 |
| 2017/0277047 A1 * | 9/2017 | Sugiura | G03G 5/043 |

FOREIGN PATENT DOCUMENTS

| | | | | |
|---|---|---|---|---|
| JP | 2004-045858 A | | 2/2004 | |
| JP | 2004-102158 A | | 4/2004 | |
| JP | 2015-152864 | * | 8/2015 | G03G 5/06 |

OTHER PUBLICATIONS

Translation of JP 2015-152864.*

* cited by examiner

*Primary Examiner* — Peter L Vajda
(74) *Attorney, Agent, or Firm* — Sughrue Mion, PLLC

(57) ABSTRACT

An electrophotographic photoreceptor includes a conductive substrate and a photosensitive layer on the conductive substrate. The electrophotographic photoreceptor has an outermost surface layer that contains fluorine-containing resin particles and an antioxidant. The fluorine-containing resin particles contain 0 or more and 30 or less carboxy groups per $10^6$ carbon atoms. A decrease in weight of the antioxidant when heated at 150° C. for 10 minutes in an air atmosphere is 40 mass % or less.

18 Claims, 2 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2020-055093 filed Mar. 25, 2020.

BACKGROUND

(i) Technical Field

The present disclosure relates to an electrophotographic photoreceptor, a process cartridge, and an image forming apparatus.

(ii) Related Art

Japanese Unexamined Patent Application Publication No. 2004-045858 proposes "an electrophotographic photoreceptor that includes a conductive support and a photosensitive layer on the conductive support, in which the photosensitive layer contains a resin and a phenol antioxidant".

Japanese Unexamined Patent Application Publication No. 2004-102158 proposes "a photoreceptor that includes a conductive support, and at least a charge generating layer containing a charge generating material and a charge transporting layer containing a charge transporting material that are sequentially stacked on the conductive support, in which the charge transporting layer is obtained by forming a film by using a coating solution that contains a non-halogen solvent, a charge transporting material, a sulfur atom-containing phenol antioxidant, and a phosphite antioxidant".

SUMMARY

Aspects of non-limiting embodiments of the present disclosure relate to an electrophotographic photoreceptor that includes a conductive substrate and a photosensitive layer on the conductive substrate, that has an outermost surface layer containing fluorine-containing resin particles, and that has good initial chargeability and an improved charge-retaining property under repeated use compared to when the fluorine-containing resin particles contain 30 or more carboxy groups per $10^6$ carbon atoms, compared to when a decrease in weight of the antioxidant when heated at 150° C. for 10 minutes in an air atmosphere is more than 40 mass %, and compared to when, when the photoreceptor is loaded onto a photoreceptor electrical property evaluation apparatus equipped with a charging device, an exposing device, and a charge erasing device, an absolute value of a difference ΔVH between VH1 and VH2 is more than 5 V, where VH1 represents a charge potential of the electrophotographic photoreceptor charged after performing one cycle of a series of charging, exposing, and charge erasing steps under conditions described below, and VH2 represents a charge potential of the electrophotographic photoreceptor charged after performing one hundred cycles of the same steps under the conditions described below:

(Conditions)

Measurement environment: temperature of 20° C./humidity of 40% RH

Charge potential: +600 V

Exposure dose: 10 mJ/$m^2$

Exposure wavelength: 780 nm

Charge erasing light source: halogen lamp

Charge erasing light wavelength: 600 nm or more and 800 nm or less

Charge erasing light dose: 30 mJ/$m^2$

Rotation rate of photoreceptor: 66.7 rpm

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrophotographic photoreceptor includes a conductive substrate and a photosensitive layer on the conductive substrate. The electrophotographic photoreceptor has an outermost surface layer that contains fluorine-containing resin particles and an antioxidant. The fluorine-containing resin particles contain 0 or more and 30 or less carboxy groups per $10^6$ carbon atoms. A decrease in weight of the antioxidant when heated at 150° C. for 10 minutes in an air atmosphere is 40 mass % or less.

BRIEF DESCRIPTION OF THE DRAWINGS

Exemplary embodiments of the present disclosure will be described in detail based on the following figures, wherein.

DETAILED DESCRIPTION

Figure 1:
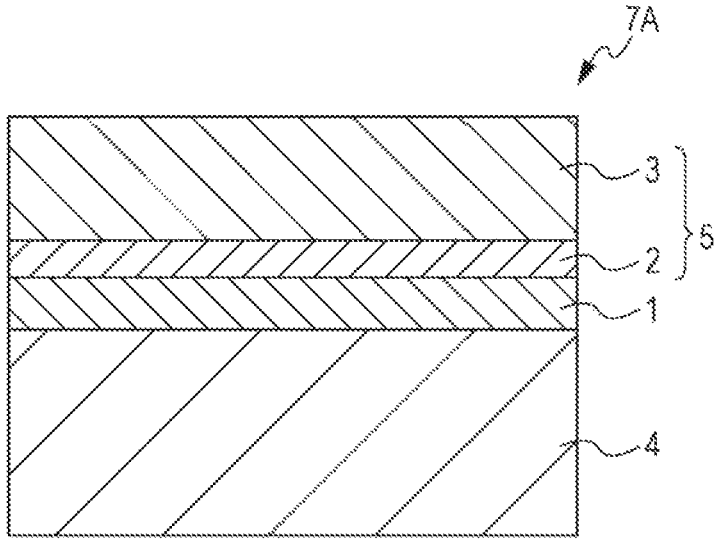
FIG. 1 is a schematic cross-sectional view of one example of a layer structure of an electrophotographic photoreceptor according to an exemplary embodiment.

Exemplary embodiments, which are some of the examples of the present disclosure, will now be described. The following descriptions and examples merely illustrate examples of the exemplary embodiments and do not limit the scope of the present disclosure.

For stepwise numerical ranges described in the present disclosure, the upper limit or the lower limit of one stepwise numerical range may be substituted with an upper limit or a lower limit of a different stepwise numerical range. In addition, for stepwise numerical ranges described in the present disclosure, the upper limit or the lower limit of any stepwise numerical range may be substituted with an upper limit or a lower limit described in the examples.

Each component may contain multiple corresponding substances.

When the amount of a component in a composition is referred and when there are two or more substances that correspond to that component in the composition, the amount is the total amount of the two or more substances in the composition unless otherwise noted.

Electrophotographic Photoreceptor

An electrophotographic photoreceptor (hereinafter may also be referred to as the "photoreceptor") according to a first exemplary embodiment includes a conductive substrate and a photosensitive layer on the conductive substrate, and the outermost surface layer of the electrophotographic photoreceptor contains fluorine-containing resin particles and an antioxidant.

In addition, the number of carboxy groups contained in the fluorine-containing resin particles is 0 or more and 30 or less per $10^6$ carbon atoms, and the decrease in weight of the antioxidant when heated at 150° C. for 10 minutes in an air atmosphere is 40 mass % or less.

The photoreceptor according to the first exemplary embodiment exhibits good initial chargeability and an improved charge-retaining property under repeated use due to the aforementioned features. The reason for this is presumably as follows.

A method that involves adding fluorine-containing resin particles to the outermost surface layer of a photoreceptor is used to improve the wear resistance of the photoreceptor. The fluorine-containing resin particles containing 0 or more and 30 or less carboxy groups per $10^6$ carbon atoms improve the chargeability of the photoreceptor, but do not readily form hydrogen bonds with hydroxy groups in the oxidant contained in the outermost surface layer. Thus, the interaction between the fluorine-containing resin particles and the antioxidant is degraded, the antioxidant becomes prone to sublimation, and thus the antioxidant content in the outermost surface layer decreases under repeated use. The antioxidant contained in the outermost surface layer not only prevents oxidation of the components in the outermost surface layer but also has an effect of capturing charges. Thus, the decrease in the antioxidant concentration in the outermost surface layer may also degrade the chargeability of the photoreceptor. That is, a photoreceptor that has an outermost surface layer containing fluorine-containing resin particles containing 0 or more and 30 or less carboxy groups per $10^6$ carbon atoms may undergo degradation in the charge-retaining property under repeated use although the initial chargeability is excellent.

Meanwhile, the outermost surface layer of the photoreceptor of the first exemplary embodiment contains an antioxidant that undergoes a decrease in weight of 40 mass % or less when heated at 150° C. for 10 minutes in an air atmosphere in addition to the fluorine-containing resin particles containing 0 to 30 carboxy groups per $10^6$ carbon atoms. The antioxidant that undergoes the decrease in weight within the aforementioned range is sparingly sublimable even in the absence of the interaction with the fluorine-containing resin particles. Thus, degradation of the charge-capturing ability caused by sublimation of the antioxidant in the outermost surface layer is suppressed.

Thus, it is anticipated that the photoreceptor according to the first exemplary embodiment exhibits good initial chargeability and an improved charge-retaining property under repeated use.

A photoreceptor according to a second exemplary embodiment includes a conductive substrate and a photosensitive layer on the conductive substrate, and the outermost surface layer of the photoreceptor contains fluorine-containing resin particles and an antioxidant.

In addition, the number of carboxy groups contained in the fluorine-containing resin particles is 0 or more and 30 or less per $10^6$ carbon atoms, and, when the photoreceptor is loaded onto a photoreceptor electrical property evaluation apparatus equipped with a charging device, an exposing device, and a charge erasing device, the absolute value of the difference ΔVH between VH1 and VH2 is 5 V or less, where VH1 represents a charge potential after charging after performing one cycle of a series of charging, exposing, and charge erasing steps under the conditions described below and VH2 represents a charge potential after charging after performing one hundred cycles of the same steps under the conditions described below:

Conditions

Measurement environment: temperature of 20° C./humidity of 40% RH

Charge potential: +600 V

Exposure dose: 10 mJ/$m^2$

Exposure wavelength: 780 nm

Charge erasing light source: halogen lamp

Charge erasing light wavelength: 600 nm or more and 800 nm or less

Charge erasing light dose: 30 mJ/$m^2$

Rotation rate of photoreceptor: 66.7 rpm

The photoreceptor according to the second exemplary embodiment exhibits good initial chargeability and an improved charge-retaining property under repeated use due to the aforementioned features. The reason for this is presumably as follows.

As described above, a photoreceptor that has an outermost surface layer containing an antioxidant and fluorine-containing resin particles containing 0 or more and 30 or less carboxy groups per $10^6$ carbon atoms may undergo a decrease in the antioxidant content in the outermost surface layer due to continuous use, resulting in degradation of the chargeability of the photoreceptor although the initial chargeability is excellent.

According to the photoreceptor of the second exemplary embodiment that contains an antioxidant and fluorine-containing resin particles containing 0 or more and 30 or less carboxy groups per $10^6$ carbon atoms, when the photoreceptor is loaded onto a photoreceptor electrical property evaluation apparatus equipped with a charging device, an exposing device, and a charge erasing device, the absolute value of the difference ΔVH between VH1 and VH2 is 5 V or less, where VH1 represents a charge potential of the electrophotographic photoreceptor charged after performing one cycle of a series of charging, exposing, and charge erasing steps under conditions described above and VH2 represents a charge potential of the electrophotographic photoreceptor charged after performing one hundred cycles of the same steps under the conditions described above. The feature that the photoreceptor of the second exemplary embodiment satisfies the aforementioned conditions means that the antioxidant is sparingly sublimable even in the absence of the interaction with the fluorine-containing resin particles, and, for example, the antioxidant used in the second exemplary embodiment is more likely to undergo a decrease of 40 mass % or less in weight when heated at 150° C. for 10 minutes in an air atmosphere. Thus, degradation of the charge-capturing ability caused by sublimation of the antioxidant in the outermost surface layer is suppressed.

Thus, it is anticipated that the photoreceptor according to the second exemplary embodiment exhibits good initial chargeability and an improved charge-retaining property under repeated use.

Hereinafter, a photoreceptor that corresponds to both the first and second exemplary embodiments (this photoreceptor may also be referred to as a "photoreceptor of the present exemplary embodiment") is described in detail. However, one example of the photoreceptor of the present disclosure may be a photoreceptor that corresponds to one of the photoreceptors of the first and second exemplary embodiments.

The electrophotographic photoreceptor of the present exemplary embodiment will now be described by referring to the drawings.

An electrophotographic photoreceptor 7A illustrated in FIG. 1 includes, for example, a conductive substrate 4, and an undercoat layer 1, a charge generating layer 2, and a charge transporting layer 3 that are stacked in this order on the conductive substrate 4. The charge generating layer 2 and the charge transporting layer 3 constitute a photosensitive layer 5.

The electrophotographic photoreceptor 7A may have a layer structure that does not include the undercoat layer 1.

The electrophotographic photoreceptor 7A may include a single-layer-type photosensitive layer in which the functions of the charge generating layer 2 and the charge transporting layer 3 are integrated. In the case of a photosensitive layer having a single-layer-type photosensitive layer, the single-layer-type photosensitive layer constitutes the outermost surface layer.

Alternatively, the electrophotographic photoreceptor 7A may include a surface protection layer on the charge transporting layer 3 or a single-layer-type photosensitive layer. In the case of a photoreceptor having a surface protection layer, the surface protection layer constitutes the outermost surface layer.

The respective layers of the electrophotographic photoreceptor of the present exemplary embodiment will now be described in detail. In the description below, the reference signs are omitted.

Conductive Substrate

Examples of the conductive substrate include metal plates, metal drums, and metal belts that contain metals (aluminum, copper, zinc, chromium, nickel, molybdenum, vanadium, indium, gold, platinum, etc.) or alloys (stainless steel etc.). Other examples of the conductive substrate include paper sheets, resin films, and belts coated, vapor-deposited, or laminated with conductive compounds (for example, conductive polymers and indium oxide), metals (for example, aluminum, palladium, and gold), or alloys. Here, "conductive" means having a volume resistivity of less than $10^{13}$ Ωcm.

The surface of the conductive substrate may be roughened to a center-line average roughness Ra of 0.04 μm or more and 0.5 μm or less in order to suppress interference fringes that occur when the electrophotographic photoreceptor used in a laser printer is irradiated with a laser beam. When incoherent light is used as a light source, there is no need to roughen the surface to prevent interference fringes, but roughening the surface suppresses generation of defects due to irregularities on the surface of the conductive substrate and thus is desirable for extending the lifetime.

Examples of the surface roughening method include a wet honing method with which an abrasive suspended in water is sprayed onto a conductive support, a centerless grinding with which a conductive substrate is pressed against a rotating grinding stone to perform continuous grinding, and an anodization treatment.

Another example of the surface roughening method does not involve roughening the surface of a conductive substrate but involves dispersing a conductive or semi-conductive powder in a resin and forming a layer of the resin on a surface of a conductive substrate so as to create a rough surface by the particles dispersed in the layer.

The surface roughening treatment by anodization involves forming an oxide film on the surface of a conductive substrate by anodization by using a metal (for example, aluminum) conductive substrate as the anode in an electrolyte solution. Examples of the electrolyte solution include a sulfuric acid solution and an oxalic acid solution. However, a porous anodization film formed by anodization is chemically active as is, is prone to contamination, and has resistivity that significantly varies depending on the environment. Thus, a pore-sealing treatment may be performed on the porous anodization film so as to seal fine pores in the oxide film by volume expansion caused by hydrating reaction in pressurized steam or boiling water (a metal salt such as a nickel salt may be added) so that the oxide is converted into a more stable hydrous oxide.

The thickness of the anodization film may be, for example, 0.3 μm or more and 15 μm or less. When the thickness is within this range, a barrier property against injection tends to be exhibited, and the increase in residual potential caused by repeated use tends to be suppressed.

The conductive substrate may be subjected to a treatment with an acidic treatment solution or a Boehmite treatment.

The treatment with an acidic treatment solution is, for example, conducted as follows. First, an acidic treatment solution containing phosphoric acid, chromic acid, and hydrofluoric acid is prepared. The blend ratios of phosphoric acid, chromic acid, and hydrofluoric acid in the acidic treatment solution may be, for example, in the range of 10 mass % or more and 11 mass % or less for phosphoric acid, in the range of 3 mass % or more and 5 mass % or less for chromic acid, and in the range of 0.5 mass % or more and 2 mass % or less for hydrofluoric acid; and the total concentration of these acids may be in the range of 13.5 mass % or more and 18 mass % or less. The treatment temperature may be, for example, 42° C. or more and 48° C. or less. The thickness of the coating film may be 0.3 μm or more and 15 μm or less.

The Boehmite treatment is conducted by immersing a conductive substrate in pure water at 90° C. or higher and 100° C. or lower for 5 to 60 minutes or by bringing a conductive substrate into contact with heated steam at 90° C. or higher and 120° C. or lower for 5 to 60 minutes. The thickness of the coating film may be 0.1 μm or more and 5 μm or less. The Boehmite-treated body may be further anodized by using an electrolyte solution, such as adipic acid, boric acid, a borate salt, a phosphate salt, a phthalate salt, a maleate salt, a benzoate salt, a tartrate salt, or a citrate salt, that has low film-dissolving power.

Undercoat Layer

The undercoat layer is, for example, a layer that contains inorganic particles and a binder resin.

Examples of the inorganic particles include inorganic particles having a powder resistivity (volume resistivity) of $10^2$ Ωcm or more and $10^{11}$ Ωcm or less.

As the inorganic particles having this resistance value, for example, metal oxide particles such as tin oxide particles, titanium oxide particles, zinc oxide particles, or zirconium oxide particles are preferable, and, in particular, zinc oxide particles are preferable.

The specific surface area of the inorganic particles measured by the BET method may be, for example, 10 $m^2/g$ or more.

The volume-average particle diameter of the inorganic particles may be, for example, 50 nm or more and 2000 nm or less (or may be 60 nm or more and 1000 nm or less).

The amount of the inorganic particles contained relative to the binder resin is, for example, preferably 10 mass % or more and 80 mass % or less, and is more preferably 40 mass % or more and 80 mass % or less.

The inorganic particles may be surface-treated. A mixture of two or more inorganic particles subjected to different surface treatments or having different particle diameters may be used.

Examples of the surface treatment agent include a silane coupling agent, a titanate coupling agent, an aluminum coupling agent, and a surfactant. In particular, a silane coupling agent is preferable, and an amino-group-containing silane coupling agent is more preferable.

Examples of the amino-group-containing silane coupling agent include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be mixed and used. For example, an amino-group-containing silane coupling agent may be used in combination with an additional silane coupling agent. Examples of this additional silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method that uses a surface treatment agent may be any known method, for example, may be a dry method or a wet method.

The treatment amount of the surface treatment agent may be, for example, 0.5 mass % or more and 10 mass % or less relative to the inorganic particles.

Here, the undercoat layer may contain inorganic particles and an electron-accepting compound (acceptor compound) from the viewpoints of improving long-term stability of electrical properties and carrier blocking properties.

Examples of the electron-accepting compound include electron transporting substances, such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis (4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

In particular, a compound having an anthraquinone structure may be used as the electron-accepting compound. Examples of the compound having an anthraquinone structure include hydroxyanthraquinone compounds, aminoanthraquinone compounds, and aminohydroxyanthraquinone compounds, and more specific examples thereof include anthraquinone, alizarin, quinizarin, anthrarufin, and purpurin.

The electron-accepting compound may be dispersed in the undercoat layer along with the inorganic particles, or may be attached to the surfaces of the inorganic particles.

Examples of the method for attaching the electron-accepting compound onto the surfaces of the inorganic particles include a dry method and a wet method.

The dry method is, for example, a method with which, while inorganic particles are stirred with a mixer or the like having a large shear force, an electron-accepting compound as is or dissolved in an organic solvent is added dropwise or sprayed along with dry air or nitrogen gas so as to cause the electron-accepting compound to attach to the surfaces of the inorganic particles. When the electron-accepting compound is added dropwise or sprayed, the temperature may be equal to or lower than the boiling point of the solvent. After the electron-accepting compound is added dropwise or sprayed, baking may be further conducted at 100° C. or higher. The temperature and time for baking are not particularly limited as long as the electrophotographic properties are obtained.

The wet method is, for example, a method with which, while inorganic particles are dispersed in a solvent by stirring, ultrasonically, or by using a sand mill, an attritor, or a ball mill, the electron-accepting compound is added, followed by stirring or dispersing, and then the solvent is removed to cause the electron-accepting compound to attach to the surfaces of the inorganic particles. The solvent is removed by, for example, filtration or distillation. After removing the solvent, baking may be further conducted at 100° C. or higher. The temperature and time for baking are not particularly limited as long as the electrophotographic properties are obtained. In the wet method, the moisture contained in the inorganic particles may be removed before adding the electron-accepting compound. For example, the moisture may be removed by stirring and heating the inorganic particles in a solvent or by boiling together with the solvent.

Attaching the electron-accepting compound may be conducted before, after, or simultaneously with the surface treatment of the inorganic particles by a surface treatment agent.

The amount of the electron-accepting compound contained relative to the inorganic particles may be, for example, 0.01 mass % or more and 20 mass % or less, and is preferably 0.01 mass % or more and 10 mass % or less.

Examples of the binder resin used in the undercoat layer include known materials such as known polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and silane coupling agents.

Other examples of the binder resin used in the undercoat layer include charge transporting resins that have charge transporting groups, and conductive resins (for example, polyaniline).

Among these, a resin that is insoluble in the coating solvent in the overlying layer is suitable as the binder resin used in the undercoat layer. Examples of the particularly suitable resin include thermosetting resins such as a urea resin, a phenolic resin, a phenol-formaldehyde resin, a melamine resin, a urethane resin, an unsaturated polyester resin, an alkyd resin, and an epoxy resin; and a resin obtained by a reaction between a curing agent and at least one resin selected from the group consisting of a polyamide resin, a polyester resin, a polyether resin, a methacrylic resin, an acrylic resin, a polyvinyl alcohol resin, and a polyvinyl acetal resin.

When two or more of these binder resins are used in combination, the mixing ratios are set as necessary.

The undercoat layer may contain various additives to improve electrical properties, environmental stability, and image quality.

Examples of the additives include known materials such as electron transporting pigments based on polycyclic condensed materials and azo materials, zirconium chelate compounds, titanium chelate compounds, aluminum chelate compounds, titanium alkoxide compounds, organic titanium compounds, and silane coupling agents. The silane coupling agent is used to surface-treat the inorganic particles as mentioned above, but may be further added as an additive to the undercoat layer.

Examples of the silane coupling agent that serves as an additive include vinyltrimethoxysilane, 3-methacryloxypropyl-tris(2-methoxyethoxy)silane, 2-(3,4-epoxycyclohexyl) ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxyaluminum diisopropylate, aluminum butyrate, diethylacetoacetate aluminum diisopropylate, and aluminum tris(ethylacetoacetate).

These additives may be used alone, or two or more compounds may be used as a mixture or a polycondensation product.

The undercoat layer may have a Vickers hardness of 35 or more.

In order to suppress moire images, the surface roughness (ten-point average roughness) of the undercoat layer may be adjusted to be in the range of 1/(4n) (n represents the refractive index of the overlying layer) to ½ of λ representing the laser wavelength used for exposure.

In order to adjust the surface roughness, resin particles and the like may be added to the undercoat layer. Examples of the resin particles include silicone resin particles and crosslinking polymethyl methacrylate resin particles. The surface of the undercoat layer may be polished to adjust the surface roughness. Examples of the polishing method included buff polishing, sand blasting, wet honing, and grinding.

The undercoat layer may be formed by any known method. For example, a coating film is formed by using an undercoat layer-forming solution prepared by adding the above-mentioned components to a solvent, dried, and, if needed, heated.

Examples of the solvent used for preparing the undercoat layer-forming solution include known organic solvents, such as alcohol solvents, aromatic hydrocarbon solvents, halogenated hydrocarbon solvents, ketone solvents, ketone alcohol solvents, ether solvents, and ester solvents.

Specific examples of the solvent include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the method for dispersing inorganic particles in preparing the undercoat layer-forming solution include known methods that use a roll mill, a ball mill, a vibrating ball mill, an attritor, a sand mill, a colloid mill, and a paint shaker.

Examples of the method for applying the undercoat layer-forming solution to the conductive substrate include common methods such as a blade coating method, a wire bar coating method, a spray coating method, a dip coating method, a bead coating method, an air knife coating method, and a curtain coating method.

The thickness of the undercoat layer is preferably set within the range of 15 μm or more, and more preferably within the range of 20 μm or more and 50 μm or less.

Intermediate Layer

Although not illustrated in the drawings, an intermediate layer may be further provided between the undercoat layer and the photosensitive layer.

The intermediate layer is, for example, a layer that contains a resin. Examples of the resin used in the intermediate layer include polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may contain an organic metal compound. Examples of the organic metal compound used in the intermediate layer include organic metal compounds containing metal atoms such as zirconium, titanium, aluminum, manganese, and silicon.

These compounds used in the intermediate layer may be used alone, or two or more compounds may be used as a mixture or a polycondensation product.

In particular, the intermediate layer may be a layer that contains an organic metal compound that contains zirconium atoms or silicon atoms.

The intermediate layer may be formed by any known method. For example, a coating film is formed by using an intermediate layer-forming solution prepared by adding the above-mentioned components to a solvent, dried, and, if needed, heated.

Examples of the application method for forming the intermediate layer include common methods such as a dip coating method, a lift coating method, a wire bar coating method, a spray coating method, a blade coating method, a knife coating method, and a curtain coating method.

The thickness of the intermediate layer may be set within the range of, for example, 0.1 μm or more and 3 μm or less. The intermediate layer may be used as the undercoat layer.

Charge Generating Layer

The charge generating layer is, for example, a layer that contains a charge generating material and a binder resin. The charge generating layer may be a vapor deposited layer of a charge generating material. The vapor deposited layer of the charge generating material may be used when an incoherent light such as a light emitting diode (LED) or an organic electro-luminescence (EL) image array is used.

Examples of the charge generating material include azo pigments such as bisazo and trisazo pigments; fused-ring aromatic pigments such as dibromoanthanthrone; perylene pigments; pyrrolopyrrole pigments; phthalocyanine pigments; zinc oxide; and trigonal selenium.

Among these, in order to be compatible to the near-infrared laser exposure, a metal phthalocyanine pigment or a metal-free phthalocyanine pigment may be used as the charge generating material. Specific examples thereof include hydroxygallium phthalocyanine disclosed in Japanese Unexamined Patent Application Publication Nos. 5-263007 and 5-279591; chlorogallium phthalocyanine disclosed in Japanese Unexamined Patent Application Publication No. 5-98181; dichlorotin phthalocyanine disclosed in Japanese Unexamined Patent Application Publication Nos. 5-140472 and 5-140473; and titanyl phthalocyanine disclosed in Japanese Unexamined Patent Application Publication No. 4-189873.

In order to be compatible to the near ultraviolet laser exposure, the charge generating material may be a fused-ring aromatic pigment such as dibromoanthanthrone, a thioindigo pigment, a porphyrazine compound, zinc oxide, trigonal selenium, a bisazo pigment disclosed in Japanese Unexamined Patent Application Publication Nos. 2004-78147 and 2005-181992, or the like.

When an incoherent light source, such as an LED or an organic EL image array having an emission center wavelength in the range of 450 nm or more and 780 nm or less, is used, the charge generating material described above may be used; however, from the viewpoint of the resolution, when the photosensitive layer is as thin as 20 μm or less, the electric field intensity in the photosensitive layer is increased, charges injected from the substrate are decreased, and image defects known as black spots tend to occur. This is particularly noticeable when a charge generating material, such as trigonal selenium or a phthalocyanine pigment, that is of a p-conductivity type and easily generates dark current is used.

In contrast, when an n-type semiconductor, such as a fused-ring aromatic pigment, a perylene pigment, or an azo pigment, is used as the charge generating material, dark current rarely occurs and, even when the thickness is small, image defects known as black spots can be suppressed. Examples of the n-type charge generating material include, but are not limited to, compounds (CG-1) to (CG-27) described in Japanese Unexamined Patent Application Publication No. 2012-155282, paragraphs [0288] to [0291].

Whether n-type or not is determined by a time-of-flight method commonly employed, on the basis of the polarity of the photocurrent flowing therein. A material in which electrons flow more smoothly as carriers than holes is determined to be of an n-type.

The binder resin used in the charge generating layer is selected from a wide range of insulating resins. Alternatively, the binder resin may be selected from organic photoconductive polymers, such as poly-N-vinylcarbazole, polyvinyl anthracene, polyvinyl pyrene, and polysilane.

Examples of the binder resin include, polyvinyl butyral resins, polyarylate resins (polycondensates of bisphenols and aromatic dicarboxylic acids etc.), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. Here, "insulating" means having a volume resistivity of $10^{13}$ Ωcm or more.

These binder resins are used alone or in combination as a mixture.

The blend ratio of the charge generating material to the binder resin may be in the range of 10:1 to 1:10 on a mass ratio basis.

The charge generating layer may contain other known additives.

The charge generating layer may be formed by any known method. For example, a coating film is formed by using an charge generating layer-forming solution prepared by adding the above-mentioned components to a solvent, dried, and, if needed, heated. The charge generating layer may be formed by vapor-depositing a charge generating material. The charge generating layer may be formed by vapor deposition particularly when a fused-ring aromatic pigment or a perylene pigment is used as the charge generating material.

Specific examples of the solvent for preparing the charge generating layer-forming solution include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents are used alone or in combination as a mixture.

In order to disperse particles (for example, the charge generating material) in the charge generating layer-forming solution, a media disperser such as a ball mill, a vibrating ball mill, an attritor, a sand mill, or a horizontal sand mill, or a media-less disperser such as stirrer, an ultrasonic disperser, a roll mill, or a high-pressure homogenizer can be used. Examples of the high-pressure homogenizer include a collision-type homogenizer in which the dispersion in a high-pressure state is dispersed through liquid-liquid collision or liquid-wall collision, and a penetration-type homogenizer in which the fluid in a high-pressure state is caused to penetrate through fine channels.

In dispersing, it is effective to set the average particle diameter of the charge generating material in the charge generating layer-forming solution to 0.5 μm or less, preferably 0.3 μm or less, and more preferably 0.15 μm or less.

Examples of the method for applying the charge generating layer-forming solution to the undercoat layer (or the intermediate layer) include common methods such as a blade coating method, a wire bar coating method, a spray coating method, a dip coating method, a bead coating method, an air knife coating method, and a curtain coating method.

The thickness of the charge generating layer is preferably set within the range of, for example, 0.1 μm or more and 5.0 μm or less, and more preferably within the range of 0.2 μm or more and 2.0 μm or less.

Charge Transporting Layer

The charge transporting layer is, for example, a layer that contains a charge transporting material and a binder resin. The charge transporting layer may be a layer that contains a polymer charge transporting material.

When the charge transporting layer is the outermost surface layer, the charge transporting layer contains, in addition to a binder resin and a charge transporting material, fluorine-containing resin particles and an antioxidant.

When another layer (for example, a protective layer or the like) is disposed on the charge transporting layer and thus the charge transporting layer is not the outermost surface layer, the charge transporting layer is to contain at least a binder resin and a charge transporting material, and may contain other additives if needed. The binder resin, the charge transporting material, and other additives are the same as when the charge transporting layer is the outermost surface layer.

The components contained in the charge transporting layer that serves as the outermost surface layer are described below.

Binder Resin

Examples of the binder resin used in the charge transporting layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, a polycarbonate resin or a polyarylate resin may be used as the binder resin. These binder resins are used alone or in combination.

The blend ratio of the charge transporting material to the binder resin may be in the range of 10:1 to 1:5 on a mass ratio basis.

The binder resin content relative to the total solid content of the photosensitive layer (charge transporting layer) is, for example, preferably 10 mass % or more and 90 mass % or less, more preferably 30 mass % or more and 90 mass % or less, and yet more preferably 50 mass % or more and 90 mass % or less.

Charge Transporting Material

Examples of the charge transporting material include electron transporting compounds such as quinone compounds such as p-benzoquinone, chloranil, bromanil, and anthraquinone; tetracyanoquinodimethane compounds; fluorenone compounds such as 2,4,7-trinitrofluorenone; xanthone compounds; benzophenone compounds; cyanovinyl compounds; and ethylene compounds. Other examples of the charge transporting material include hole transporting compounds such as triarylamine compounds, benzidine compounds, aryl alkane compounds, aryl-substituted ethylene compounds, stilbene compounds, anthracene compounds, and hydrazone compounds. These charge transporting materials may be used alone or in combination, but are not limiting.

From the viewpoint of charge mobility, the charge transporting material may be a triaryl amine derivative represented by structural formula (a-1) below or a benzidine derivative represented by structural formula (a-2) below.

(a-1)

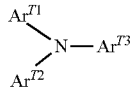

In structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent for each of the groups described above include a halogen atom, an alkyl group having 1 to 5 carbon atoms, and an alkoxy group having 1 to 5 carbon atoms. Examples of the substituent for each of the groups described above include a substituted amino group substituted with an alkyl group having 1 to 3 carbon atoms.

(a-2)

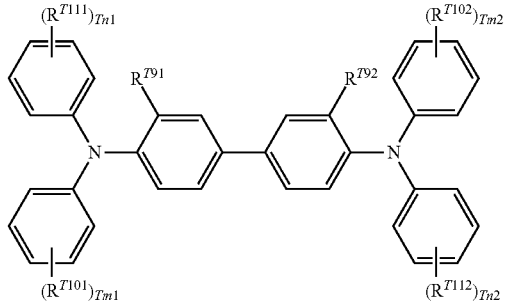

In structural formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{T15})(R^{T16})$; and $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer of 0 or more and 2 or less.

Examples of the substituent for each of the groups described above include a halogen atom, an alkyl group having 1 to 5 carbon atoms, and an alkoxy group having 1 to 5 carbon atoms. Examples of the substituent for each of the groups described above include a substituted amino group substituted with an alkyl group having 1 to 3 carbon atoms.

Here, among the triarylamine derivatives represented by structural formula (a-1) and the benzidine derivatives represented by structural formula (a-2) above, a triarylamine derivative having $—C_6H_4—CH=CH—CH=C(R^{T7})(R^{T8})$ or a benzidine derivative having $—CH=CH—CH=C(R^{T15})(R^{T16})$ may be used from the viewpoint of the charge mobility.

Examples of the polymer charge transporting material that can be used include known charge transporting materials such as poly-N-vinylcarbazole and polysilane. In particular, polyester polymer charge transporting materials disclosed in Japanese Unexamined Patent Application Publication Nos. 8-176293 and 8-208820 are particularly preferable. The polymer charge transporting material may be used alone or in combination with a binder resin.

Fluorine-Containing Resin Particles

Examples of the fluorine-containing resin particles include particles of a fluoroolefin homopolymer, and particles of a copolymer of two or more monomers which are at least one fluoroolefin monomer and a non-fluorine monomer (monomer free of fluorine atoms).

Examples of the fluoroolefin include perhaloolefins such as tetrafluoroethylene (TFE), perfluorovinylether, hexafluoropropylene (HFP), and chlorotrifluoroethylene (CTFE), and non-perfluoroolefins such as vinylidene fluoride (VdF), trifluoroethylene, and vinyl fluoride. Among these, VdF, TFE, CTFE, HFP, or the like may be used.

Examples of the non-fluorine monomers include hydrocarbon olefins such as ethylene, propylene and butene; alkyl vinyl ethers such as cyclohexyl vinyl ether (CHVE), ethyl vinyl ether (EVE), butyl vinyl ether, and methyl vinyl ether; alkenyl vinyl ethers such as polyoxyethylene allyl ether (POEAE) and ethyl allyl ether; organosilicon compounds having a reactive, α,β-unsaturated group such as vinyltrimethoxysilane (VSi), vinyltriethoxysilane, and vinyltris (methoxyethoxy)silane; acrylic esters such as methyl acrylate and ethyl acrylate; methacrylic esters such as methyl methacrylate and ethyl methacrylate; and vinyl esters such as vinyl acetate, vinyl benzoate, and "Beova" (trade name, vinyl ester manufactured by Shell). Among these, alkyl vinyl ether, allyl vinyl ether, vinyl ester, and an organosilicon compound having a reactive α,β-unsaturated group may be used.

Among these, particles having a high fluorination ratio may be used as the fluorine-containing resin particles. Particles of polytetrafluoroethylene (PTFE), a tetrafluoroethylene-hexafluoropropylene copolymer (FEP), a tetrafluoroethylene-perfluoro(alkyl vinyl ether) copolymer (PFA), an ethylene-tetrafluoroethylene copolymer (ETFE), an ethylene, chlorotrifluoroethylene copolymer (ECTFE), and the like are more preferable, and particles of PTFE, FEP, and PFA are particularly preferable.

The number of carboxy groups in the fluorine-containing resin particles is 0 or more and 30 or less per $10^6$ carbon atoms.

When the number of carboxy groups in the fluorine-containing resin particles is within the aforementioned range, the chargeability can be improved.

The number of carboxy groups in the fluorine-containing resin particles may be 0 or more and 20 or less from the viewpoint of improving the chargeability.

The carboxy groups in the fluorine-containing resin particle are, for example, carboxy groups derived from the terminal carboxylic acid contained in the fluorine-containing resin particle.

Examples of the method for reducing the number of carboxy groups in the fluorine-containing resin particle include 1) a method that does not apply radiation during the process of producing particles, and 2) a method in which irradiation is performed in the absence of oxygen or under a reduced oxygen concentration condition.

The number of carboxy groups in the fluorine-containing resin particles is measured as follows according to the disclosure in Japanese Unexamined Patent Application Publication No. 4-20507, for example.

Fluorine-containing resin particles are pre-formed by a pressing machine into a film having a thickness of about 0.1 mm. An infrared absorption spectrum of the prepared film is measured. An infrared absorption spectrum of fluorine-containing resin particles in which carboxylic acid terminals are completely fluorinated by allowing the fluorine-containing resin particles to contact fluorine gas is also measured, and the number of terminal carboxy groups is determined from the following formula from the difference between the two spectra:

$$\text{number of groups (per } 10^6 \text{ carbon atoms)} = (l \times K)/t$$

l: absorbance
K: correction factor
t: thickness (mm) of film

The absorption wavenumber of the carboxy group is assumed to be 3560 $cm^{-1}$, and the correction factor is assumed to be 440.

Examples of the fluorine-containing resin particles include particles obtained by radiation irradiation (in this description, also referred to as the "irradiated fluorine-containing resin particles") and particles obtained by polymerization (in this description, also referred to as the "polymerized fluorine-containing resin particles").

The irradiated fluorine-containing resin particles (the fluorine-containing resin particles obtained by irradiation with radiation) refer to fluorine-containing resin particles that have been given a particle form during radiation polymerization, and fluorine-containing resin particles obtained by irradiating a polymerized fluorine-containing resin with radiation so as to decompose the resin to reduce the molecular weight and to give a particle form.

The irradiated fluorine-containing resin particles contain many carboxy groups since large quantities of carboxylic acids occur by irradiation in air.

Meanwhile, polymerized fluorine-containing resin particles (fluorine-containing resin particles obtained by polymerization) refer to fluorine-containing resin particles that have become particles during polymerization such as suspension polymerization or emulsion polymerization and that are not irradiated with radiation.

The fluorine-containing resin particles may be polymerized fluorine-containing resin particles. As mentioned above, the polymerized fluorine-containing resin particles are formed into particles during polymerization such as suspension polymerization or emulsion polymerization, and are not irradiated.

An example of the method for preparing fluorine-containing resin particles by suspension polymerization involves suspending, in a dispersion medium, a monomer that forms a fluorine-containing resin, and additives such as a polymerization initiator and a catalyst, and then forming particles of a polymer while polymerizing the monomer.

An example of the method for preparing fluorine-containing resin particles by emulsion polymerization involves emulsifying, in a dispersion medium, a monomer that forms a fluorine-containing resin, and additives such as a polymerization initiator and a catalyst by using a surfactant (namely, an emulsifier), and then forming particles of a polymer while polymerizing the monomer.

In particular, the fluorine-containing resin particles may be particles obtained without irradiation in the production process.

However, irradiated fluorine-containing resin particles that have been irradiated with radiation in the absence of oxygen or under a reduced oxygen concentration condition may be used as the fluorine-containing resin particles.

The average particle diameter of the fluorine-containing resin particles is not particularly limited, but is preferably 0.2 μm or more and 4.5 μm or less and more preferably 0.2 μm or more and 4 μm or less.

The average particle diameter of the fluorine-containing resin particles is the value measured by the following method.

Using a scanning electron microscope (SEM), particles are observed at a magnification of, for example, 5000× or more, the maximum diameters of the fluorine-containing resin particles (secondary particles formed by agglomeration of primary particles) are measured, and the average of fifty particles is used as the average particle diameter of the fluorine-containing resin particles. The SEM used is JSM- 6700F produced by JEOL Ltd., and a secondary electron image at an accelerating voltage of 5 kV is observed.

The specific surface area (BET specific surface area) of the fluorine-containing resin particles is preferably 5 $m^2/g$ or more and 15 $m^2/g$ or less and more preferably 7 $m^2/g$ or more and 13 $m^2/g$ or less from the viewpoint of dispersion stability.

The specific surface area is a value measured by a BET-type specific surface area meter (FlowSorb 112300 produced by Shimadzu Corporation) by a nitrogen substitution method.

The apparent density of the fluorine-containing resin particles is preferably 0.2 g/ml or more and 0.5 g/ml or less and more preferably 0.3 g/ml or more and 0.45 g/ml or less from the viewpoint of dispersion stability.

The apparent density is a value measured in accordance with JIS K 6891 (1995).

The melting temperature of the fluorine-containing resin particles is preferably 300° C. or more and 340° C. or less and more preferably 325° C. or more and 335° C. or less.

The melting temperature is a melting temperature measured in accordance with JIS K 6891 (1995).

From the viewpoint of improving the chargeability of the photoreceptor, the fluorine-containing resin particle content relative to the outermost surface layer is preferably 5 mass % or more and 20 mass % or less, more preferably 5 mass % or more and 15 mass % or less, and yet more preferably 8 mass % or more and 10 mass % or less.

Antioxidant

The photoreceptor of the present exemplary embodiment includes an outermost surface layer containing an antioxidant.

Examples of the antioxidant include substances that prevent or suppress the activity of oxygen under conditions such as light, heat, and discharge against the oxidizing substances that exist in the inside and on the surface of the electrophotographic photoreceptor.

Specific examples of the antioxidant include radical polymerization inhibitors and peroxide decomposers. Examples of the radical polymerization inhibitors include known antioxidants such as hindered phenol antioxidants, hindered amine antioxidants, diallylamine antioxidants, diallyldiamine antioxidants, and hydroquinone antioxidants. Examples of the peroxide decomposers include known antioxidants such as organic sulfur (for example, thioether) antioxidants, phosphoric acid antioxidants, dithiocarbamic acid salt antioxidants, thiourea antioxidants, and benzimidazole antioxidants.

The antioxidant contained in the outermost surface layer undergoes a decrease in weight of 40 mass % or less when heated at 150° C. for 10 minutes.

When the decrease in weight of the antioxidant is within the aforementioned range, sublimation of the antioxidant from inside the photosensitive layer is suppressed.

From the viewpoint of suppressing sublimation of the antioxidant from inside the photosensitive layer, the decrease in weight of the antioxidant when heated at 150° C. for 10 minutes is preferably 0 mass % or more and 20 mass % or less and more preferably 0 mass % or more and 5 mass % or less.

The decrease in weight is measured by measuring the mass of the antioxidant before and after heating at 150° C. for 10 minutes and then calculating the rate of decrease in weight.

In order to adjust the decrease in weight of the antioxidant to be within the aforementioned range, the antioxidant described below may be used.

The molecular weight of the antioxidant is preferably 240 or more and 350 or less, more preferably 270 or more and 350 or less, and yet more preferably 300 or more and 350 or less.

When the molecular weight of the antioxidant is within the aforementioned range and the antioxidant is contained in the photosensitive layer, sublimation of the antioxidant from inside the photosensitive layer is suppressed.

The antioxidant may be a compound having two or more benzene rings in a molecule.

When the antioxidant has two or more benzene rings in a molecule and the antioxidant is contained in the photosensitive layer, sublimation of the antioxidant from inside the photosensitive layer is suppressed.

The antioxidant may be a hindered phenol antioxidant. A hindered phenol antioxidant is a compound having a hindered phenol ring.

The hindered phenol ring in the hindered phenol antioxidant is, for example, a phenol ring substituted with at least one alkyl group having 4 to 8 carbon atoms (for example, a branched alkyl group having 4 to 8 carbon atoms). More specifically, the hindered phenol ring is, for example, a phenol ring in which the ortho position with respect to the phenolic hydroxy group is substituted with a tertiary alkyl group (for example, a tert-butyl group).

Examples of the hindered phenol antioxidant include the following:

1) an antioxidant having one hindered phenol ring
2) an antioxidant having 2 or more and 4 or less hindered phenol rings that are linked to one another via linking groups formed of linear or branched divalent to tetravalent aliphatic hydrocarbon groups or linking groups having at least one of ester bonds (—C(═O)O—) and ether bonds (—O—) interposed between the carbon-carbon-bonds of the divalent to tetravalent aliphatic hydrocarbon groups
3) an antioxidant having 2 or more and 4 or less hindered phenol rings and one benzene ring (an unsubstituted benzene ring or a benzene ring substituted with an alkyl group or the like) or an isocyanurate ring, in which 2 or more and 4 or less hindered phenol rings are linked to one another via a benzene ring or an isocyanurate ring and an alkylene group.

From the viewpoint of suppressing sublimation of the antioxidant from inside the photosensitive layer, the hindered phenol antioxidant may be 2) or 3) described above.

Specifically, from the viewpoint of suppressing sublimation of the antioxidant from inside the photosensitive layer, the hindered phenol antioxidant may be an antioxidant represented by formula (HP) below:

(HP)

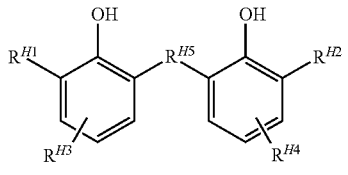

In formula (HP), $R^{H1}$ and $R^{H2}$ each independently represent a branched alkyl group having 4 to 8 carbon atoms.

$R^{H3}$ and $R^{H4}$ each independently represent a hydrogen atom or an alkyl group having 1 to 10 carbon atoms.

$R^{H5}$ represents an alkylene group having 1 to 10 carbon atoms.

Examples of the alkyl groups represented by $R^{H1}$ and $R^{H2}$ in formula (HP) include branched alkyl groups having 4 to 8 carbon atoms (preferably 4 to 6 carbon atoms).

Specific examples of the branched alkyl groups include an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, and a tert-octyl group.

Among these, a tert-butyl group and a tert-pentyl group are preferable as the alkyl group, and a tert-butyl group is more preferable as the alkyl group.

In formula (HP), examples of $R^{H3}$ and $R^{H4}$ include linear or branched alkyl groups having 1 to 10 carbon atoms (preferably 1 to 4 carbon atoms).

Specific examples of the linear alkyl groups include a methyl group, an ethyl group, an n-propyl group, an n-butyl group, an n-pentyl group, an n-hexyl group, an n-heptyl group, an n-octyl group, an n-nonyl group, and an n-decyl group.

Specific examples of the branched alkyl groups include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

Among these, lower alkyl groups such as a methyl group and an ethyl group are preferable as the alkyl group.

In formula (HP), $R^{H5}$ represents a linear or branched alkylene group having 1 to 10 carbon atoms (preferably 1 to 4 carbon atoms).

Examples of the linear alkylene group include a methylene group, an ethylene group, an n-propylene group, an n-butylene group, an n-pentylene group, an n-hexylene group, an n-heptylene group, an n-octylene group, an n-nonylene group, and an n-decylene group.

Specific examples of the branched alkylene group include an isopropylene group, an isobutylene group, a sec-butylene group, a tert-butylene group, an isopentylene group, a neopentylene group, a tert-pentylene group, an isohexylene group, a sec-hexylene group, a tert-hexylene group, an isoheptylene group, a sec-heptylene group, a tert-heptylene group, an isooctylene group, a sec-octylene group, an tert-octylene group, an isononylene group, a sec-nonylene group, a tert-nonylene group, an isodecylene group, a sec-decylene group, and a tert-decylene group.

Among these, lower alkylene groups such as a methylene group, an ethylene group, and a butylene group are preferable as the alkylene group.

In formula (HP), the respective substituents represented by $R^{H1}$, $R^{H2}$, $R^{H3}$, $R^{H4}$, and $R^{H5}$ include groups further having substituents. Examples of such substituents include halogen atoms (for example, a fluorine atom and a chlorine atom), alkoxy groups (for example, alkoxy groups having 1 to 4 carbon atoms), and aryl groups (for example, a phenyl group and a naphthyl group).

In formula (HP), from the viewpoint of suppressing sublimation of the antioxidant from inside the photosensitive layer, $R^{H1}$ and $R^{H2}$ preferably each represent a tert-butyl group, and, more preferably, $R^{H1}$ and $R^{H2}$ each represent a tert-butyl group, $R^{H3}$ and $R^{H4}$ each represent an alkyl group having 1 to 3 carbon atoms (in particular, a methyl group), and $R^{H5}$ represents an alkylene group having 1 to 4 carbon atoms (in particular, a methylene group).

Specifically, the hindered phenol antioxidant is particularly preferably an exemplary compound (HP-3).

Specific examples of the hindered phenol antioxidants are described below but these examples are not limiting.

(HP-1)

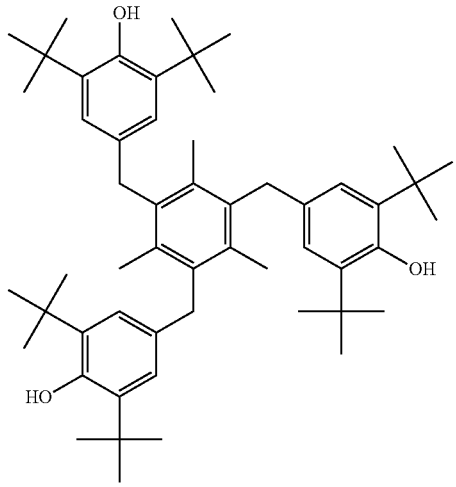

(HP-2)

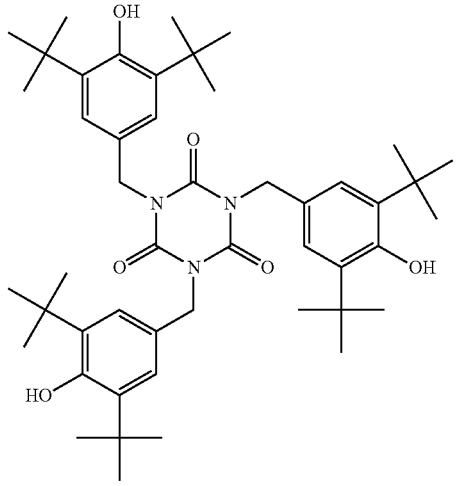

(HP-3)

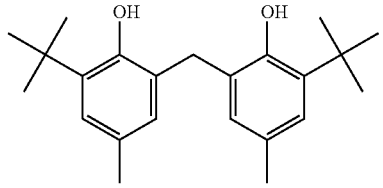

(HP-4)

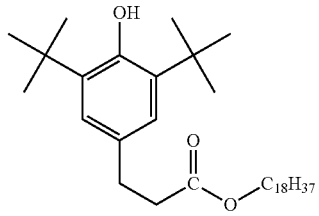

-continued (HP-5)

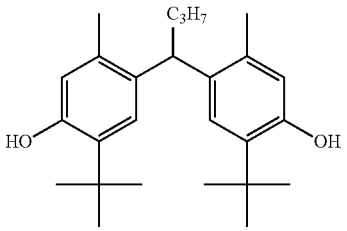

(HP-6)

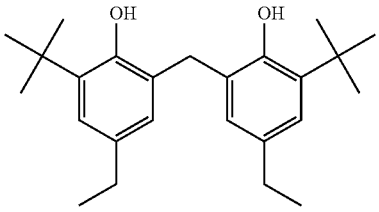

(HP-7)

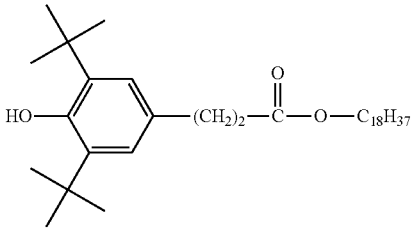

(HP-8)

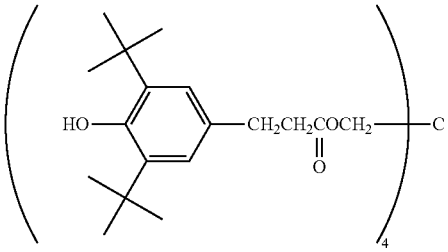

(HP-9)

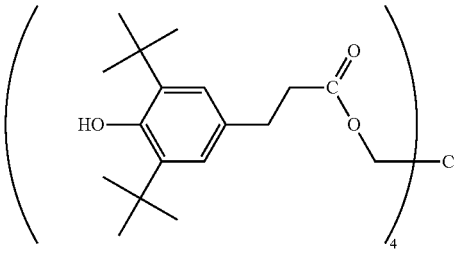

(HP-10)

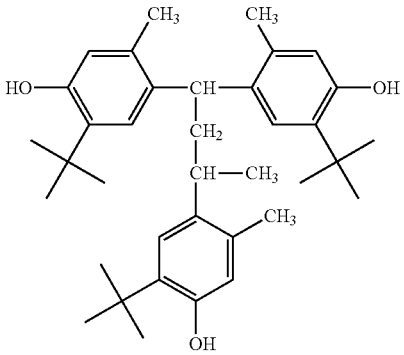

-continued (HP-11)

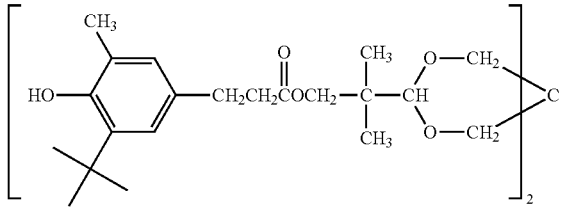

The hindered phenol antioxidants may be used alone or in combination.

From the viewpoint of suppressing sublimation of the antioxidant from inside the photosensitive layer, the antioxidant content relative to the fluorine-containing resin particle content is preferably 20 mass % or more and 60 mass % or less and more preferably 30 mass % or more and 50 mass % or less.

Additives, Forming Method, and Film Thickness

The charge transporting layer may contain other known additives.

The charge transporting layer may be formed by any known method. For example, the charge transporting layer is formed by preparing a charge transporting layer-forming solution containing the aforementioned components and a solvent, forming a coating film by using the solution, and drying and, if needed, heating the coating film.

Examples of the solvent used to prepare the charge transporting layer-forming solution include common organic solvents such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. These solvents are used alone or in combination as a mixture.

Examples of the method for applying the charge transporting layer-forming solution to the charge generating layer include common methods such as a blade coating method, a wire bar coating method, a spray coating method, a dip coating method, a bead coating method, an air knife coating method, and a curtain coating method.

The thickness of the charge transporting layer is preferably set within the range of, for example, 5 μm or more and 50 μm or less, and more preferably within the range of 10 μm or more and 30 μm or less.

Protective Layer

A protective layer is disposed on a photosensitive layer if necessary. The protective layer is, for example, formed to avoid chemical changes in the photosensitive layer during charging and further improve the mechanical strength of the photosensitive layer.

Thus, the protective layer may be a layer formed of a cured film (crosslinked film). Examples of such a layer include layers indicated in 1) and 2) below.

1) A layer formed of a cured film of a composition that contains a reactive-group-containing charge transporting material having a reactive group and a charge transporting skeleton in the same molecule (in other words, a layer that contains a polymer or crosslinked body of the reactive-group-containing charge transporting material).

2) A layer formed of a cured film of a composition that contains a non-reactive charge transporting material, and a reactive-group-containing non-charge transporting material that does not have a charge transporting skeleton but has a reactive group (in other words, a layer that contains a polymer or crosslinked body of the non-reactive charge transporting material and the reactive-group-containing non-charge transporting material).

Examples of the reactive group contained in the reactive-group-containing charge transporting material include known reactive groups such as chain-polymerizable groups, an epoxy group, —OH, —OR (where R represents an alkyl group), —$NH_2$, —SH, —COOH, and —$SiR^{Q1}_{3-Qn}(OR^{Q2})_{Qn}$ (where $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of 1 to 3).

The chain-polymerizable group may be any radical-polymerizable functional group, and an example thereof is a functional group having a group that contains at least a carbon-carbon double bond. A specific example thereof is a group that contains at least one selected from a vinyl group, a vinyl ether group, a vinyl thioether group, a styryl group (vinylphenyl group), an acryloyl group, a methacryloyl group, and derivatives thereof. Among these, the chain-polymerizable group may be a group that contains at least one selected from a vinyl group, a styryl group (vinylphenyl group), an acryloyl group, a methacryloyl group, and derivatives thereof due to their excellent reactivity.

The charge transporting skeleton of the reactive-group-containing charge transporting material may be any known structure used in the electrophotographic photoreceptor, and examples thereof include skeletons that are derived from nitrogen-containing hole transporting compounds, such as triarylamine compounds, benzidine compounds, and hydrazone compounds, and that are conjugated with nitrogen atoms. Among these, a triarylamine skeleton is preferable.

The reactive-group-containing charge transporting material that has such a reactive group and a charge transporting skeleton, the non-reactive charge transporting material, and the reactive-group-containing non-charge transporting material may be selected from among known materials.

The protective layer may contain other known additives. The protective layer may be formed by any known method. For example, a coating film is formed by using a protective layer-forming solution prepared by adding the above-mentioned components to a solvent, dried, and, if needed, cured such as by heating.

Examples of the solvent used to prepare the protective layer-forming solution include aromatic solvents such as toluene and xylene, ketone solvents such as methyl ethyl ketone, methyl isobutyl ketone, and cyclohexanone, ester solvents such as ethyl acetate and butyl acetate, ether solvents such as tetrahydrofuran and dioxane, cellosolve solvents such as ethylene glycol monomethyl ether, and alcohol solvents such as isopropyl alcohol and butanol. These solvents are used alone or in combination as a mixture.

The protective layer-forming solution may be a solvent-free solution.

Examples of the application method used to apply the protective layer-forming solution onto the photosensitive layer (for example, the charge transporting layer) include common methods such as a dip coating method, a lift coating method, a wire bar coating method, a spray coating method, a blade coating method, a knife coating method, and a curtain coating method.

The thickness of the protective layer is preferably set within the range of, for example, 1 μm or more and 20 μm or less, and more preferably within the range of 2 μm or more and 10 μm or less.

Single-Layer-Type Photosensitive Layer

The single-layer-type photosensitive layer (charge generating/charge transporting layer) is, for example, a layer that contains a charge generating material, a charge transporting material, and, optionally, a binder resin and other known additives. These materials are the same as those described in relation to the charge generating layer and the charge transporting layer.

The amount of the charge generating material contained in the single-layer-type photosensitive layer relative to the total solid content may be 0.1 mass % or more and 10 mass % or less, and is preferably 0.8 mass % or more and 5 mass % or less. The amount of the charge transporting material contained in the single-layer-type photosensitive layer relative to the total solid content may be 5 mass % or more and 50 mass % or less.

The method for forming the single-layer-type photosensitive layer is the same as the method for forming the charge generating layer and the charge transporting layer.

The thickness of the single-layer-type photosensitive layer may be, for example, 5 μm or more and 50 μm or less, and is preferably 10 μm or more and 40 μm or less.

Difference ΔVH in Charge Potential

According to the photoreceptor of the present exemplary embodiment, when the photoreceptor is loaded onto a photoreceptor electrical property evaluation apparatus equipped with a charging device, an exposing device, and a charge erasing device, the absolute value of the difference ΔVH between VH1 and VH2 is 5 V or less, VH1 represents a charge potential of the electrophotographic photoreceptor charged after performing one cycle of a series of charging, exposing, and charge erasing steps under conditions described above and VH2 represents a charge potential of the electrophotographic photoreceptor charged after performing one hundred cycles of the same steps under the conditions described above.

Sublimation of the antioxidant from inside the photosensitive layer is suppressed because the photoreceptor of the present exemplary embodiment has the aforementioned features.

In order to adjust the absolute value of the difference ΔVH in charge potential to be within the aforementioned range, the outermost surface layer of the photoreceptor may contain an antioxidant that undergoes a decrease in weight of 40 mass % or less when heated at 150° C. for 10 minutes and fluorine-containing resin particles having 0 or more and 30 or less carboxy groups per $10^6$ carbon atoms.

From the viewpoints of the initial chargeability of the photoreceptor and improving the charge-retaining property under repeated use, the absolute value of the difference ΔVH between VH1 and VH2 is more preferably 4 V or less and yet more preferably 3.5 V or less.

The absolute value of the difference ΔVH in charge potential of the photoreceptor is measured as follows.

The photoreceptor is loaded onto a photoreceptor electrical property evaluation apparatus produced by Fuji Xerox Co., Ltd., equipped with a charging device, an exposing device, and a charge erasing device. After one cycle of a series of charging, exposing, and charge erasing steps is performed under the following conditions, charging is performed, and the charge potential of the photoreceptor surface is measured and assumed to be VH1. Next, after a total of one hundred cycles of a series of charging, exposing, and charge erasing steps are performed under the following conditions, charging is performed, and the charge potential of the photoreceptor surface is measured. The measured value is assumed to be VH2, and the absolute value of the difference ΔVH between VH1 and VH2 is calculated.

The charge potential of the photoreceptor surface is measured with a surface potentiometer (Trek 334 produced by Trek Japan Co., Ltd.), at a position 1 mm away from the photoreceptor surface.

Conditions

Measurement environment: temperature of 20° C./humidity of 40% RH

Charge potential: +600 V

Exposure dose: 10 mJ/m$^2$

Exposure wavelength: 780 nm

Charge erasing light source: halogen lamp (produced by Lin Watch Industry Co., Ltd.)

Charge erasing light wavelength: 600 nm or more and 800 nm or less

Charge erasing light dose: 30 mJ/m$^2$

Rotation rate of photoreceptor: 66.7 rpm

Image Forming Apparatus (and Process Cartridge)

An image forming apparatus of an exemplary embodiment includes an electrophotographic photoreceptor, a charging unit that charges a surface of the electrophotographic photoreceptor, an electrostatic latent image forming unit that forms an electrostatic latent image on the charged surface of the electrophotographic photoreceptor, a developing unit that develops the electrostatic latent image on the surface of the electrophotographic photoreceptor by using a developer that contains a toner so as to form a toner image, and a transfer unit that transfers the toner image onto a surface of a recording medium. The photoreceptor of the present exemplary embodiment described above is used as the electrophotographic photoreceptor.

The image forming apparatus of the exemplary embodiment is applied to a known image forming apparatus, examples of which include an apparatus equipped with a fixing unit that fixes the toner image transferred onto the surface of the recording medium; a direct transfer type apparatus with which the toner image formed on the surface of the electrophotographic photoreceptor is directly transferred to the recording medium; an intermediate transfer type apparatus with which the toner image formed on the surface of the electrophotographic photoreceptor is first transferred to a surface of an intermediate transfer body and then the toner image on the surface of the intermediate transfer body is transferred to the surface of the recording medium; an apparatus equipped with a cleaning unit that cleans the surface of the electrophotographic photoreceptor after the toner image transfer and before charging; an apparatus equipped with a charge erasing unit that erases the charges on the surface of the electrophotographic photoreceptor by applying the charge erasing light after the toner image transfer and before charging; and an apparatus equipped with an electrophotographic photoreceptor heating member that elevates the temperature of the electrophotographic photoreceptor to reduce the relative temperature.

In the intermediate transfer type apparatus, the transfer unit includes, for example, an intermediate transfer body having a surface onto which a toner image is to be transferred, a first transfer unit that conducts first transfer of the toner image on the surface of the electrophotographic photoreceptor onto the surface of the intermediate transfer body, and a second transfer unit that conducts second transfer of the toner image on the surface of the intermediate transfer body onto a surface of a recording medium.

The image forming apparatus of this exemplary embodiment may be of a dry development type or a wet development type (development type that uses a liquid developer).

In the image forming apparatus of the exemplary embodiment, for example, a section that includes the electrophotographic photoreceptor may be configured as a cartridge structure (process cartridge) detachably attachable to the image forming apparatus. A process cartridge equipped with the photoreceptor of the present exemplary embodiment may be used as this process cartridge. The process cartridge may include, in addition to the electrophotographic photoreceptor, at least one selected from the group consisting of a charging unit, an electrostatic latent image forming unit, a developing unit, and a transfer unit.

Although some examples of the image forming apparatus of an exemplary embodiment are described below, these examples are not limiting. Only relevant sections illustrated in the drawings are described, and descriptions of other sections are omitted.

Figure 2:
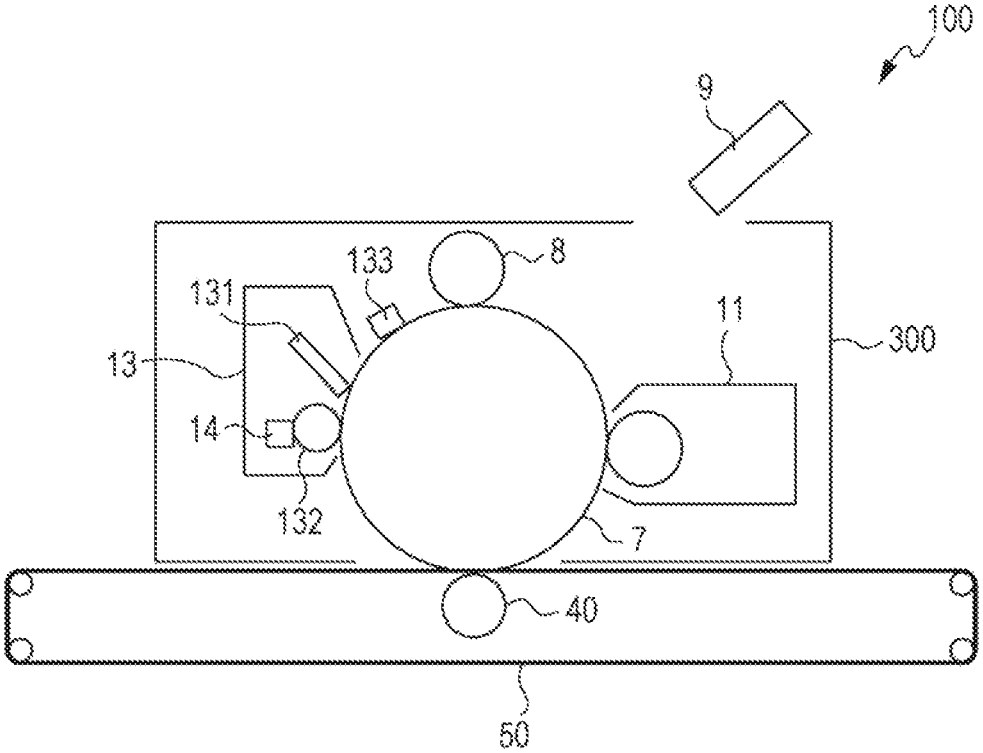
FIG. 2 is a schematic diagram illustrating one example of an image forming apparatus according to an exemplary embodiment.

FIG. 2 is a schematic diagram illustrating one example of an image forming apparatus according to an exemplary embodiment.

As illustrated in FIG. 2, an image forming apparatus 100 of this exemplary embodiment includes a process cartridge 300 equipped with an electrophotographic photoreceptor 7, an exposing device 9 (one example of the electrostatic latent image forming unit), a transfer device 40 (first transfer device), and an intermediate transfer body 50. In this image forming apparatus 100, the exposing device 9 is positioned so that light can be applied to the electrophotographic photoreceptor 7 from the opening of the process cartridge 300, the transfer device 40 is positioned to oppose the electrophotographic photoreceptor 7 with the intermediate transfer body 50 therebetween, and the intermediate transfer body 50 has a portion in contact with the electrophotographic photoreceptor 7. Although not illustrated in the drawings, a second transfer device that transfers the toner image on the intermediate transfer body 50 onto a recording medium (for example, a paper sheet) is also provided. The intermediate transfer body 50, the transfer device 40 (first transfer device), and the second transfer device (not illustrated) correspond to examples of the transfer unit.

The process cartridge 300 illustrated in FIG. 2 integrates and supports the electrophotographic photoreceptor 7, a charging device 8 (one example of the charging unit), a developing device 11 (one example of the developing unit), and a cleaning device 13 (one example of the cleaning unit) in the housing. The cleaning device 13 has a cleaning blade (one example of the cleaning member) 131, and the cleaning blade 131 is in contact with the surface of the electrophotographic photoreceptor 7. The cleaning member may take a form other than the cleaning blade 131, and may be a conductive or insulating fibrous member that can be used alone or in combination with the cleaning blade 131.

Although an example of the image forming apparatus equipped with a fibrous member 132 (roll) that supplies a lubricant 14 to the surface of the electrophotographic photoreceptor 7 and a fibrous member 133 (flat brush) that assists cleaning is illustrated in FIG. 2, these members are optional.

The features of the image forming apparatus of this exemplary embodiment will now be described.

Charging Device

Examples of the charging device 8 include contact-type chargers that use conductive or semi-conducting charging rollers, charging brushes, charging films, charging rubber blades, and charging tubes. Known chargers such as non-contact-type roller chargers, and scorotron chargers and corotron chargers that utilize corona discharge are also used.

Exposing Device

Examples of the exposing device 9 include optical devices that can apply light, such as semiconductor laser light, LED, or liquid crystal shutter light, into a particular image shape onto the surface of the electrophotographic photoreceptor 7. The wavelength of the light source is to be within the spectral sensitivity range of the electrophotographic photoreceptor. The mainstream wavelength of the semiconductor lasers is near infrared having an oscillation wavelength at about 780 nm. However, the wavelength is not limited to this, and a laser having an oscillation wavelength on the order of 600 nm or a blue laser having an oscillation wavelength of 400 nm or more and 450 nm or less may be used. In order to form a color image, a surface-emitting laser light source that can output multi beams is also effective.

Developing Device

Examples of the developing device 11 include common developing devices that perform development by using a developer in contact or non-contact manner. The developing device 11 is not particularly limited as long as the aforementioned functions are exhibited, and is selected according to the purpose. An example thereof is a known developer that has a function of attaching a one-component developer or a two-component developer to the electrophotographic photoreceptor 7 by using a brush, a roller, or the like. In particular, a development roller that retains the developer on its surface may be used.

The developer used in the developing device 11 may be a one-component developer that contains only a toner or a two-component developer that contains a toner and a carrier. The developer may be magnetic or non-magnetic. Any known developers may be used as these developers.

Cleaning Device

A cleaning blade type device equipped with a cleaning blade 131 is used as the cleaning device 13.

Here, a member that constitutes a region of the cleaning blade 131, the region contacting the electrophotographic photoreceptor 7, is referred to as a "contact member".

Furthermore, when the contact member and a region other than the contact member in the cleaning blade 131 are composed of different materials, the member that constitute the region other than the contact member is referred to as a "non-contact member". The non-contact member may be composed of one material or may be constituted by two or more members composed of different materials.

The cleaning blade 131 of the present exemplary embodiment may be solely formed of the contact member.

At least a portion of the cleaning blade 131 that contacts the electrophotographic photoreceptor 7 (in other words, this portion is the contact member) may be constituted by a member that contains a polyurethane rubber and has an endothermic peak top temperature within the range of 180° C. or more and 220° C. or less in differential scanning calorimetry.

When at least the contact member of the cleaning blade 131 contains a polyurethane rubber and has an endothermic peak top temperature within the aforementioned range as measured by differential scanning calorimetry, appropriately high crystallinity is imparted due to the polyurethane, and the wear resistance of the cleaning blade is improved. As a result, the photoreceptor is scraped from the surface layer side in an appropriate manner, and thus the refreshing property of a small quantity of the sublimized antioxidant is improved.

The lower limit of the endothermic peak top temperature (melting temperature) is preferably 185° C. or more and more preferably 190° C. or more. The upper limit of the endothermic peak top temperature (melting temperature) is preferably 215° C. or less and more preferably 210° C. or less.

The endothermic peak top temperature of the cleaning blade 131 is measured in compliance with ASTM D 2418-99.

A Diamond-DSC produced by PerkinElmer Co., Ltd., is used for measurement, the temperature correction of the detecting unit of the apparatus is carried out by using the melting temperatures of indium and zinc, and the calorific value is corrected by using heat of fusion of indium. An aluminum pan is used for the measurement sample, and an empty pan is set as a control for the measurement. Here, the temperature elevation rate during DSC measurement is set to 3° C./min, and the measurement temperature range is set to 20° C. to 250° C.

One example of the method for controlling the endothermic peak top temperature to be within the aforementioned range is promoting growth of hard segment aggregates in the polyurethane. Specifically, an environment that promotes growth of hard segment aggregates is created by adjusting the progress of crosslinking such that physical crosslinking (crosslinking caused by hydrogen bonding between hard segments) proceeds more efficiently than chemical crosslinking (crosslinking caused by a crosslinking agent) during formation of the crosslinked structure in the polyurethane. There is a tendency the aging time becomes longer as the polymerization temperature during polyurethane polymerization is set lower, and thus the physical crosslinking proceeds more extensively as a result.

Here, the "hard segment" refers to a material that is relatively hard among the polyurethane rubber materials. Meanwhile, the "soft segment" refers to a material that is relatively soft among the polyurethane rubber materials.

A polyurethane rubber is typically synthesized by polymerizing a polyisocyanate and a polyol. Alternatively, a resin having a functional group that can react with isocyanate groups may be used instead of the polyol. The polyurethane rubber may contain a hard segment and a soft segment.

The combination of the material constituting the hard segment (hard segment material) and the material constituting the soft segment (soft segment material) is not particularly limited, and any combination of a material that is hard relative to the other and a material that is soft relative to the other selected from known resin materials can be used. In the present exemplary embodiment, the following combinations are recommendable.

Soft Segment Material

Examples of the soft segment material include polyols, and examples of the polyols include polyester polyols obtained by dehydration condensation between a diol and a dibasic acid, polycarbonate polyols obtained by reaction between a diol and an alkyl carbonate, polycaprolactone polyols, and polyether polyols. Examples of the commercially available products of the polyol used as the soft segment material include PLACCEL 205 and PLACCEL 240 produced by DAICEL CORPORATION.

Hard Segment Material

A resin having a functional group that can react with isocyanate groups may be used as the hard segment material. The resin may be flexible, and an aliphatic resin having a linear structure can be used from the viewpoint of flexibility. Specific examples thereof include an acrylic resin containing two or more hydroxy groups, a polybutadiene resin containing two or more hydroxy groups, and an epoxy resin containing two or more epoxy groups.

When a hard segment material and a soft segment material are to be used, the mass ratio of the material constituting the hard segment to the total amount of the hard segment material and the soft segment material (hereinafter this ratio is referred to as the "hard segment material ratio") is preferably within the range of 10 mass % or more and 30 mass % or less, more preferably within the range of 13 mass % or more and 23 mass % or less, and yet more preferably within the range of 15 mass % or more and 20 mass % or less.

When the hard segment material ratio is 10 mass % or more, the wear resistance is obtained, and an excellent cleaning property is maintained over a long term. Meanwhile, when the hard segment material ratio is 30 mass % or less, the hardness is not excessively high, flexibility and expansibility are obtained, occurrence of chipping is suppressed, and an excellent cleaning property is maintained over a long term.

Polyisocyanate

Examples of the polyisocyanate used in synthesizing the polyurethane rubber include 4,4'-diphenylmethane diisocyanate (MDI), 2,6-toluene diisocyanate (TDI), 1,6-hexane diisocyanate (HDI), 1,5-naphthalene diisocyanate (NDI), and 3,3-dimethylphenyl-4,4-diisocyanate (TODI).

From the viewpoint of ease of forming hard segment aggregates having a desired size (particle diameter), 4,4'-diphenylmethane diisocyanate (MDI), 1,5-naphthalene diisocyanate (NDI), and hexamethylene diisocyanate (HDI) are more preferable.

The blend amount of the polyisocyanate relative to 100 parts by mass of the resin having a functional group that can react with the isocyanate groups is preferably 20 parts by mass or more and 40 parts by mass or less, more preferably 20 parts by mass or more and 35 parts by mass or less, and yet more preferably 20 parts by mass or more and 30 parts by mass or less.

When the amount is 20 parts by mass or more, a large amount of urethane bonds is obtained, and thus the hard segment grows and the desired hardness is obtained. Meanwhile, when the amount is 40 parts by mass or less, the hard segment does not grow excessively large, the expansibility is obtained, and thus chipping of the cleaning blade is suppressed.

Crosslinking Agent

Examples of the crosslinking agent include diols (difunctional), triols (trifunctional), and tetrols (tetrafunctional), and these crosslinking agents may be used in combination. Amine compounds may also be used as the crosslinking agent. A trifunctional or higher crosslinking agent may be used for crosslinking. Examples of the trifunctional crosslinking agent include trimethylolpropane, glycerin, and triisopropanolamine.

The blend amount of the crosslinking agent relative to 100 parts by mass of the resin having a functional group that can react with the isocyanate groups is preferably 2 parts by mass or less. When the amount is 2 parts by mass or less, molecular motions are not restrained by chemical crosslinking, a hard segment derived from urethane bonds caused by aging grows large, and thus the desired hardness is easily obtained.

Method for Producing Polyurethane Rubber

The polyurethane rubber member constituting the contact member in the present exemplary embodiment is produced by a typical polyurethane production method such as a prepolymer method and a one-shot method. The prepolymer method is suitable for the present exemplary embodiment since a polyurethane having excellent wear resistance is obtained, but the production method is not limited.

An example of the way to control the endothermic peak top temperature (melting temperature) in the contact member to be within the aforementioned range is a method that involves controlling the temperature within the appropriate range while increasing the crystallinity of the polyurethane member, for example, a method involving promoting growth of hard segment aggregates in the polyurethane. A specific example is a method that involves adjusting the process so that physical crosslinking (crosslinking caused by hydrogen bonding between hard segments) proceeds more efficiently than chemical crosslinking (crosslinking caused by a crosslinking agent) during formation of the crosslinked structure in the polyurethane, and there is a tendency that the aging time increases by setting the polymerization temperature during polyurethane polymerization to lower temperatures, and thus progress of physical crosslinking is promoted.

Such a polyurethane rubber member is formed by blending an isocyanate compound, a crosslinking agent, etc., to the aforementioned polyol under such forming conditions that suppress non-uniformity in molecular alignment.

Specifically, when preparing a polyurethane composition, the process is adjusted to slow the progress of crosslinking by decreasing the temperature of the polyol and the prepolymer, and decreasing the temperatures for curing and forming. Setting these temperatures (temperature of the polyol and the prepolymer, and temperatures for curing and forming) to low temperatures decreases the reactivity, causes the urethane bond portions to aggregate, and forms a crystal body of a hard segment; thus, the temperatures are adjusted so that the particle diameter of the hard segment aggregates is adjusted to the desired crystal diameter.

As a result, the molecules contained in the polyurethane composition line up, and a polyurethane rubber member that contains a crystal body having an endothermic peak top temperature of the crystal fusion energy within the aforementioned range as measured by DSC is formed.

The amounts of the polyol, the polyisocyanate, and the crosslinking agent, the ratio of the crosslinking agent, etc., are adjusted to be within the desired ranges.

The cleaning blade is prepared by molding a cleaning blade-forming composition prepared by the aforementioned method into a sheet by, for example, centrifugal molding, extrusion molding, or the like, and cutting the resulting sheet.

The weight-average molecular weight of the polyurethane rubber member in the present exemplary embodiment is preferably in the range of 1000 to 4000 and more preferably in the range of 1500 to 3500.

Non-Contact Member

The non-contact member of the cleaning blade of the present exemplary embodiment is not particularly limited, and any known material can be used.

Examples of the material used in the non-contact member include polyurethane rubber, silicone rubber, fluororubber, chloroprene rubber, and butadiene rubber. Among these, polyurethane rubber is recommendable. Examples of the polyurethane rubber include ester polyurethane and ether polyurethane, and ester polyurethane is particularly preferable.

For producing a polyurethane rubber, there is a method that uses a polyol and a polyisocyanate.

Examples of the polyol include polytetramethyl ether glycol, polyethylene adipate, and polycaprolactone.

Examples of the polyisocyanate include 2,6-toluene diisocyanate (TDI), 4,4'-diphenylmethane diisocyanate (MDI), paraphenylene diisocyanate (PPDI), 1,5-naphthalene diisocyanate (NDI), and 3,3-dimethyldiphenyl-4,4'-diisocyanate (TODI). Among these, MDI is preferable.

Furthermore, examples of the curing agent that cures the polyurethane include 1,4-butanediol, trimethylolpropane, ethylene glycol, and mixtures thereof.

For example, a prepolymer obtained by a reaction induced by mixing diphenylmethane-4,4-diisocyanate and dehydrated polytetramethyl ether glycol may be used in combination with 1,4-butanediol and trimethylolpropane both serving as curing agents. Optionally, additives such as a reaction adjustor may be added.

The method for preparing the non-contact member is a known method suitable for the raw material used in preparation, and, for example, the non-contact member is prepared by molding the material by centrifugal molding, extrusion molding, or the like, and cutting the molded product into a predetermined shape.

Production of Cleaning Blade

When the cleaning blade is constituted by the contact member and the non-contact member, the cleaning blade is prepared by bonding together a first layer that serves as the contact member and a second layer (when a layer structure including three or more layers is concerned, multiple second layers) that serves as the non-contact member. The bonding method may employ a double-sided tape, various adhesives, etc. Alternatively, the materials for the respective layers may be poured into a mold with time intervals during molding so that multiple layers are bonded together by the bonds between the materials without providing adhesive layers.

In addition to the cleaning blade system, a fur brush cleaning system or a development-cleaning simultaneous system may be employed.

Transfer Device

Examples of the transfer device 40 include contact-type transfer chargers that use belts, rollers, films, rubber blades, etc., and known transfer chargers such as scorotron transfer chargers and corotron transfer chargers that utilize corona discharge.

Intermediate Transfer Body

A belt-shaped member (intermediate transfer belt) that contains semi-conducting polyimide, polyamide imide, polycarbonate, polyarylate, a polyester, a rubber, or the like is used as the intermediate transfer body 50. The form of the intermediate transfer body other than the belt may be a drum.

Figure 3:
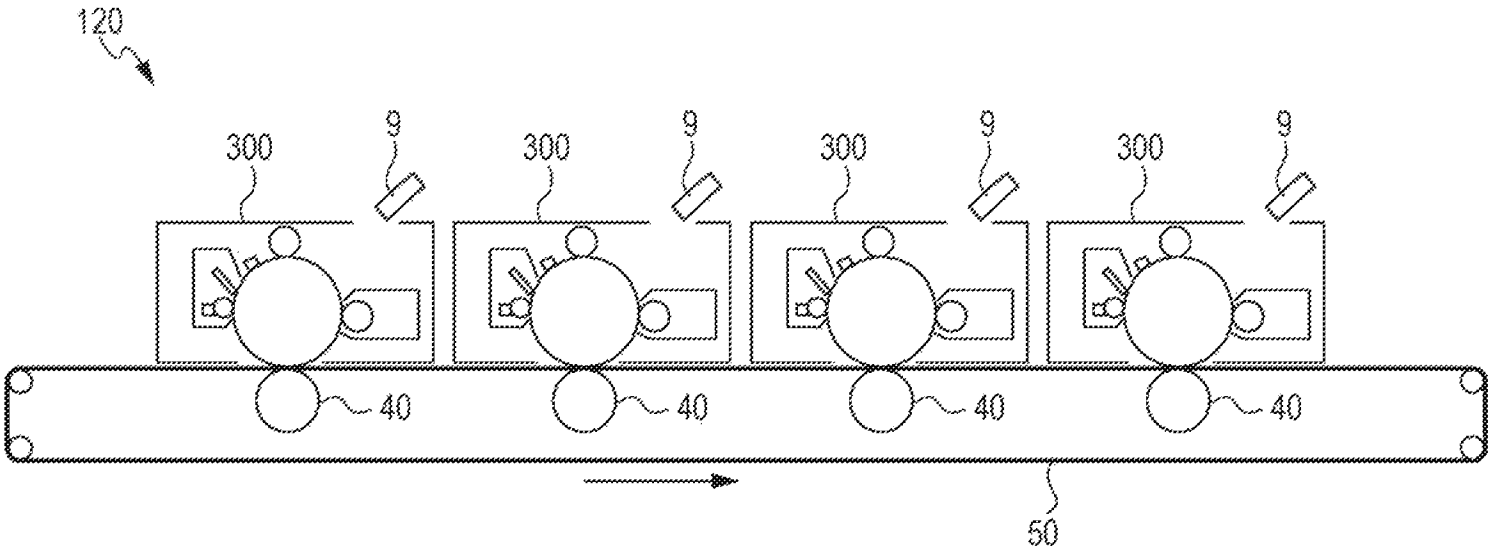
FIG. 3 is a schematic diagram illustrating another example of an image forming apparatus according to an exemplary embodiment.

FIG. 3 is a schematic diagram illustrating another example of an image forming apparatus according to an exemplary embodiment.

An image forming apparatus 120 illustrated in FIG. 3 is a tandem-system multicolor image forming apparatus equipped with four process cartridges 300. In the image forming apparatus 120, four process cartridges 300 are arranged in parallel on the intermediate transfer body 50, and one electrophotographic photoreceptor is used for one color. The image forming apparatus 120 is identical to the image forming apparatus 100 except for the tandem system.

EXAMPLES

Examples described below are not to be construed as limiting the present disclosure. In the description below, "parts" and "%" are all on a mass basis unless otherwise noted.

Production of Fluorine-Containing Resin Particles

Production of Fluorine-Containing Resin Particles (1)

Fluorine-containing resin particles (1) are produced as follows.

Into an autoclave, 3 L of deionized water, 3.0 g of ammonium perfluorooctanoate, and 110 g of paraffin wax (produced by Nippon Oil Corporation) serving as an emulsion stabilizer are charged, the interior is substituted with nitrogen three times and with tetrafluoroethylene (TFE) twice to remove oxygen, and stirring is performed at 250 rpm by adjusting the internal pressure to 1.0 MPa with TFE while maintaining the internal temperature to 70° C. Next, ethane in an amount equivalent to 150 cc at normal pressure serving as a chain transfer agent and 20 mL of an aqueous solution dissolving 300 mg of ammonium persulfate serving as a polymerization initiator are charged into the system, and the reaction is started. During the reaction, the temperature inside the system is maintained at 70° C., and TFE is continuously supplied so that the internal pressure of the autoclave is constantly maintained at 1.0±0.05 MPa. At the time 1000 g of TFE is consumed by the reaction after addition of the initiator, supply of TFE and stirring are stopped, and the reaction is terminated. Subsequently, particles are centrifugally separated, 400 parts by mass of methanol is taken, the mixture is washed for 10 minutes in a stirrer at 250 rpm while applying ultrasonic waves, and the supernatant is filtered. This operation is repeated three times, and the residue is dried at a reduced pressure at 60° C. for 17 hours.

Through the above-described steps, fluorine-containing resin particles (1) are produced.

Production of Fluorine-Containing Resin Particles (C1)

Fluorine-containing resin particles (C1) are produced as follows.

To a barrier nylon bag, 100 parts by mass of a homopolytetrafluoroethylene fine powder (standard specific gravity measured in accordance with ASTM D 4895 (2004): 2.175) and 2.4 parts by mass of ethanol serving as an additive are added. Subsequently, a cobalt −60γ line is applied at 150 kGy in air at room temperature to obtain a low-molecular-weight polytetrafluoroethylene powder. The obtained powder is crushed to obtain fluorine-containing resin particles (C1).

Production of Cleaning Blade

Production of Cleaning Blade (1)

A cleaning blade (1) is produced as follows.

First, polycaprolactone polyol (PLACCEL 205 produced by DAICEL CORPORATION, average molecular weight: 529, hydroxy value: 212 KOHmg/g) and polycaprolactone polyol (PLACCEL 240 produced by DAICEL CORPORATION, average molecular weight: 4155, hydroxy value: 27 KOHmg/g) are used as the soft segment materials for the polyol component. An acrylic resin containing 2 or more hydroxy groups (ACTFLOW UMB-2005B produced by Soken Chemical & Engineering Co., Ltd.) is used as a hard segment material, and the soft segment materials and hard segment material are mixed at a ratio of 8:2 (mass ratio).

Next, to 100 parts of the mixture of the soft segment materials and the hard segment material, 6.26 parts of 4,4'-diphenylmethane diisocyanate (Millionate MT produced by NIPPON POLYURETHANE KOGYO KK) serving as the isocyanate compound is added, and the reaction is carried out in a nitrogen atmosphere at 70° C. for 3 hours. The amount of the isocyanate compound used in this reaction is selected so that the ratio of isocyanate groups to the hydroxy groups in the reaction system (isocyanate group/hydroxy group) is 0.5.

Subsequently, 34.3 parts of the isocyanate compound is further added, and the reaction is carried out in a nitrogen atmosphere at 70° C. for 3 hours to obtain a prepolymer. The total amount of the isocyanate compound used for the prepolymer is 40.56 parts.

Next, the prepolymer is heated to 100° C. and degassed for 1 hour at a reduced pressure. Subsequently, to 100 parts of the prepolymer, 7.14 parts of a mixture of 1,4-butanediol and trimethylolpropane (mass ratio=60/40) is added, and the resulting mixture is mixed for 3 minutes while avoiding bubbling. As a result, a cleaning blade-forming composition A1 is obtained.

Next, the cleaning blade-forming composition Al is poured into a centrifugal molding machine with a die adjusted at 140° C., and the curing reaction is carried out for 1 hour. Next, the composition is aged and heated at 110° C. for 24 hours, cooled, and cut so as to obtain a cleaning blade (1) (in Table 2, referred to as the "BLD1").

Production of Cleaning Blade (2)

A cleaning blade (2) is produced as follows.

A cleaning blade (2) (in Table 2, referred to as the "BLD2") is prepared as with the cleaning blade (1) except that the aging and curing temperature is changed to 75° C.

Production of Cleaning Blade (3)

A cleaning blade (3) is produced as follows.

A cleaning blade (3) (in Table 2, referred to as the "BLD3") is prepared as with the cleaning blade (1) except that the aging and curing temperature is changed to 75° C. and the aging and curing time is changed to 32 hours.

Production of Cleaning Blade (4)

A cleaning blade (4) is produced as follows.

A cleaning blade (4) (in Table 2, referred to as the "BLD4") is prepared as with the cleaning blade (1) except that the aging and curing temperature is changed to 75° C. and the weight ratio of the mixture of 1,4-butanediol and trimethylolpropane is changed to 70/30.

Production of Cleaning Blade (5)

A cleaning blade (5) is produced as follows.

A cleaning blade (5) (in Table 2, referred to as the "BLD5") is prepared as with the cleaning blade (1) except that the soft segment material is changed to 1,9-ND adipate having a molecular weight of 2000 obtained from 1,9-nonanediol and adipic acid.

Example 1

Preparation of Photoreceptor

A photoreceptor is prepared as follows.

One hundred parts of zinc oxide (average particle diameter: 70 nm, produced by Tayca Corporation, specific surface area: 15 $m^2/g$) is mixed with 500 parts of tetrahydrofuran, and 1.4 parts of a silane coupling agent (KBE503 produced by Shin-Etsu Chemical Co., Ltd.) is added thereto, followed by stirring for 2 hours. Then, tetrahydrofuran is distilled away by vacuum distillation, baking is performed at 120° C. for 3 hours, and, as a result, zinc oxide surface-treated with the silane coupling agent is obtained.

One hundred and ten parts of the surface-treated zinc oxide and 500 parts of tetrahydrofuran are mixed and stirred, a solution prepared by dissolving 0.6 parts of alizarin in 50 parts of tetrahydrofuran is added to the resulting mixture, and the resulting mixture is stirred at 50° C. for 5 hours. Subsequently, alizarin-doped zinc oxide is separated by vacuum filtration and vacuum-dried at 60° C. As a result, alizarin-doped zinc oxide is obtained.

Sixty parts of the alizarin-doped zinc oxide, 13.5 parts of a curing agent (blocked isocyanate, Sumidur 3175 produced by Sumitomo Bayer Urethane Co., Ltd.), 15 parts of a butyral resin (S-LEC BM-1 produced by Sekisui Chemical Co., Ltd.), and 85 parts of methyl ethyl ketone are mixed to obtain a mixed solution. Thirty eight parts of this mixed solution and 25 parts of methyl ethyl ketone are mixed, and the resulting mixture is dispersed for 2 hours in a sand mill using 1 mmϕ glass beads to obtain a dispersion.

To the obtained dispersion, 0.005 parts of dioctyltin dilaurate serving as a catalyst and 30 parts of silicone resin particles (Tospearl 145 produced by Momentive Performance Materials Japan LLC) are added to obtain an undercoat layer-forming solution. The coating solution is applied to a cylindrical aluminum substrate, and dried and cured at 170° C. for 30 minutes so as to form an undercoat layer having a thickness of 24 μm.

Next, 1 part of hydroxygallium phthalocyanine having intense diffraction peaks at Bragg's angles (2θ±0.2°) of 7.5°, 9.9°, 12.5°, 16.3°, 18.6°, 25.1°, and 28.3° in an X-ray diffraction spectrum, 1 part of polyvinyl butyral (S-LEC BM-5 produced by Sekisui Chemical Co., Ltd.), and 80 parts of n-butyl acetate are mixed, and the resulting mixture is dispersed with glass beads in a paint shaker for 1 hour to prepare a charge generating layer-forming solution. The obtained solution is applied to the undercoat layer on the conductive substrate by dip-coating, and heated at 130° C. for 10 minutes to form a charge generating layer having a thickness of 0.15 μm.

In 350 parts of toluene and 150 parts of tetrahydrofuran, 45 parts of a benzidine compound represented by formula (CTM1) below serving as a charge transporting material and 55 parts of a polymer compound (viscosity-average molecular weight: 40,000) having a repeating unit represented by formula (PCZ1) below are dissolved, and, thereto, 11.2 parts of the fluorine-containing resin particles (1) and 3 parts of a compound represented by formula (HP-2) (ADK STAB AO-20 produced by Adeka Corporation) serving as an antioxidant (Add1) are added. The resulting mixture is processed with a high-pressure homogenizer 5 times so as to obtain a charge transporting layer-forming coating solution.

The obtained coating solution is applied to the charge generating layer by dip-coating, and heated at 130° C. for 45 minutes to prepare a charge transporting layer having a thickness of 31 μm.

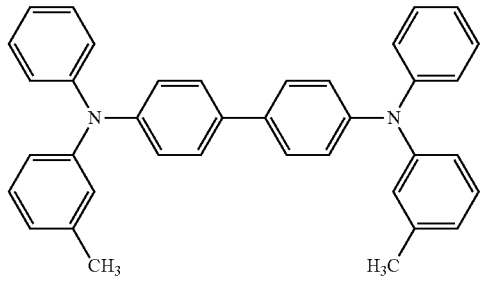

(CTM1)

(PCZ1)

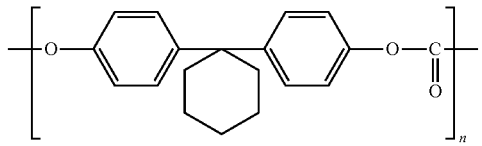

Photoreceptors are prepared through the steps described above.

Preparation of Process Cartridge

The prepared photoreceptor is loaded onto a process cartridge equipped with the cleaning blade (1) for an image forming apparatus (DocuCentre-V C7775 produced by Fuji Xerox Co., Ltd.) to obtain a process cartridge.

Examples 2 to 17 and Comparative Examples 1 to 8

Photoreceptors and process cartridges are prepared as in Example 1 except that the type and added amount of the fluorine-containing resin particles, the type and added amount of the antioxidant, and the type of the cleaning blade are changed as indicated in Tables 1 and 2.

Evaluation

Evaluation of Lubricity

For each of the outermost surface layers of the photoreceptors of the respective examples, the coefficient of friction is measured continuously 30 times by a HEIDON resistance measurement method under the following measurement conditions, and the average of the 10th to the 20th measured values is calculated. A dynamic coefficient of friction of the stylus is measured as the coefficient of friction. The name of the measurement instrument used in measuring the coefficient of friction is as follows:

TRIBOGEAR (Variable Normal Load Friction and Wear Measurement System) produced by Shinto Scientific Co., Ltd.: TYPE HHS2000 (standard analytical software is used)

Measurement Conditions

Material of stylus: diamond, shape of stylus tip: R=0.2 mm, load: 20 g, stylus contact angle: 90° (perpendicular direction with respect to the photoreceptor surface), stylus travel distance: 10 mm each way in reciprocating motions, number of times of reciprocation: 30

Standard for Evaluation of Lubricity

A: less than 0.6

B: 0.6 or more but less than 0.7

C: 0.7 or more

Measurement of Absolute Value of ΔVH

The photoreceptors obtained in the respective examples are each loaded onto a photoreceptor electrical property evaluation apparatus produced by Fuji Xerox Co., Ltd., and the absolute value of the difference ΔVH between the VH1 and the VH2 is measured by the aforementioned procedure.

Actual Device Evaluation

Image Forming Apparatus for Evaluation

The process cartridges obtained in the respective examples are each loaded onto DocuCentre-V C7775 produced by Fuji Xerox Co., Ltd. By using a surface potentiometer (Trek 334 produced by Trek Japan Co., Ltd.), a surface potential probe is installed at a position 1 mm remote from the surface of the photoreceptor and in the region to be measured.

This apparatus is used as the image forming apparatus for evaluating the following initial chargeability and charge-retaining property.

Initial Chargeability Evaluation

After the surface potential after charging is set to −700 V, by using the image forming apparatus for evaluation, an all-screen halftone image having an image density of 30% is output on 1 sheet of A4 paper in a high-temperature, high-humidity environment (temperature: 28° C., humidity: 85% RH). Then the surface potential is measured with a surface potentiometer and evaluated by the following evaluation standard:

A: Surface potential is −700 V or more but less than −680 V

B: Surface potential is −680 V or more but less than −660 V

C: Surface potential is −660 V or more

Evaluation of Charge-Retaining Property

After the surface potential after charging is set to −700 V, by using the image forming apparatus for evaluation, an all-screen halftone image having an image density of 30% is output on 70,000 sheets of A4 paper in a high-temperature, high-humidity environment (temperature: 28° C., humidity: 85% RH). Then the surface potential is measured with a surface potentiometer and evaluated by the following evaluation standard:

A: Surface potential is −700 V or more but less than −680 V

B: Surface potential is −680 V or more but less than −660 V

C: Surface potential is −660 V or more

Descriptions in the tables are as follows.

The antioxidant type "Add1" indicates a compound represented by formula (HP-2) (ADK STAB AO-20 produced by Adeka Corporation).

The antioxidant type "Add2" indicates 2,2'-methylenebis (6-tert-butyl-p-cresol) (product name: Sumilizer MDP-S produced by Sumitomo Chemical Co., Ltd.) (a compound represented by formula (HP-3)).

The antioxidant type "Add3" indicates tris(nonylphenyl) phosphite (product name: Sumilizer TNP produced by Sumitomo Chemical Co., Ltd.).

The antioxidant type "Add4" indicates butylated hydroxyanisole.

The antioxidant type "Add5" indicates dibutylhydroxytoluene.

The antioxidant type "Add6" indicates compound name: 2-phenylethyl(E)-cinnamate (produced by Tokyo Chemical Industry Co., Ltd.).

"–" indicates the absence of the fluorine-containing resin particles or that it is not possible to calculate the numerical value of the corresponding item due to the absence of the fluorine-containing resin particles.

The "Content (mass %) Relative to charge transporting layer" of the fluorine-containing resin particles indicates the fluorine-containing resin particle content relative to the charge transporting layer, and the unit thereof is mass %.

The "Content (mass %) Relative to particles" of the antioxidant indicates the antioxidant content relative to the content of the fluorine-containing resin particles contained in the charge transporting layer, and the unit thereof is mass %.

The "Number of benzene rings" of the antioxidant indicates the number of benzene rings in one molecule of the antioxidant.

"|ΔVH| (V)" indicates the absolute value of the difference ΔVH between VH1 and VH2.

TABLE 1

| | Fluorine-containing resin particles | | | Antioxidant | | | | | Cleaning blade | | Evaluation | | | |
|---|---|---|---|---|---|---|---|---|---|---|---|---|---|---|
| | Type | Amount of COOH (Number) | Content Relative to charge transporting layer (Mass %) | Type | Content Relative to particles (Mass %) | Molecular weight | Number of benzene rings | Decrease in weight (Mass %) | Type | Endothermic peak top temperature (° C.) | \|ΔVH\| (V) | Lubricity | Initial chargeability | Charge-retaining property |
| Example 1 | (1) | 7 | 9.8 | Add1 | 26.8 | 784.08 | 4 | 0.0 | BLD1 | 190 | 2.1 | A | A | A |
| Example 2 | (1) | 7 | 9.8 | Add3 | 26.8 | 689.00 | 3 | 0.0 | BLD1 | 190 | 6.8 | A | A | B |
| Example 3 | (1) | 7 | 9.8 | Add1 | 26.8 | 784.08 | 4 | 0.0 | BLD1 | 190 | 8.1 | A | A | B |
| Example 4 | (1) | 7 | 9.8 | Add6 | 26.8 | 252.31 | 2 | 0.0 | BLD1 | 190 | 3.3 | A | A | A |
| Example 5 | (1) | 7 | 9.8 | Add2 | 55 | 340.50 | 2 | 35.0 | BLD1 | 190 | 2.9 | A | A | A |
| Example 6 | (1) | 7 | 9.8 | Add2 | 70 | 340.50 | 2 | 35.0 | BLD1 | 190 | 7.6 | A | B | B |
| Example 7 | (1) | 7 | 9.8 | Add2 | 25 | 340.50 | 2 | 35.0 | BLD1 | 190 | 1.9 | A | A | A |
| Example 8 | (1) | 7 | 9.8 | Add2 | 15 | 340.50 | 2 | 35.0 | BLD1 | 190 | 9.1 | A | B | B |
| Example 9 | (1) | 7 | 15.0 | Add3 | 26.8 | 689.00 | 3 | 0.0 | BLD1 | 190 | 2.4 | A | A | A |
| Example 10 | (1) | 7 | 25.0 | Add3 | 26.8 | 689.00 | 3 | 0.0 | BLD1 | 190 | 5.4 | A | B | B |
| Example 11 | (1) | 7 | 8.2 | Add3 | 26.8 | 689.00 | 3 | 0.0 | BLD1 | 190 | 2.5 | A | A | A |
| Example 12 | (1) | 7 | 7.5 | Add3 | 26.8 | 689.00 | 3 | 0.0 | BLD1 | 190 | 5.6 | B | A | B |
| Example 14 | (1) | 7 | 9.8 | Add3 | 26.8 | 689.00 | 3 | 0.0 | BLD2 | 215 | 2.2 | A | A | A |
| Example 15 | (1) | 7 | 9.8 | Add3 | 26.8 | 689.00 | 3 | 0.0 | BLD3 | 217 | 2.5 | A | A | A |
| Example 16 | (1) | 7 | 9.8 | Add3 | 26.8 | 689.00 | 3 | 0.0 | BLD4 | 225 | 8.1 | A | A | B |
| Example 17 | (1) | 7 | 9.8 | Add3 | 26.8 | 689.00 | 3 | 0.0 | BLD5 | 170 | 5.9 | A | A | B |

TABLE 2

| | Fluorine-containing resin particles | | | Antioxidant | | | | | Cleaning blade | | Evaluation | | | |
|---|---|---|---|---|---|---|---|---|---|---|---|---|---|---|
| | Type | Amount of COOH (Number) | Content Relative to charge transporting layer (Mass %) | Type | Content Relative to particles (Mass %) | Molecular weight | Number of benzene rings | Decrease in weight (Mass %) | Type | Endothermic peak top temperature (° C.) | \|ΔVH\| (V) | Lubricity | Initial chargeability | Charge-retaining property |
| Comparative Example 1 | (1) | 7 | 9.8 | Add4 | 26.8 | 180.24 | 1 | 45.0 | BLD1 | 190 | 12.3 | A | A | C |
| Comparative Example 2 | (1) | 7 | 9.8 | Add5 | 26.8 | 220.35 | 1 | 45.0 | BLD1 | 190 | 15.4 | A | A | C |
| Comparative Example 3 | (C1) | 75 | 9.8 | Add1 | 26.8 | 784.08 | 4 | 0.0 | BLD1 | 190 | 4.1 | A | C | A |
| Comparative Example 4 | (C1) | 75 | 9.8 | Add2 | 26.8 | 340.50 | 2 | 35.0 | BLD1 | 190 | 3.6 | A | C | A |
| Comparative Example 5 | (Cl) | 75 | 9.8 | Add3 | 26.8 | 689.00 | 3 | 0.0 | BLD1 | 190 | 3.6 | A | C | A |
| Comparative Example 6 | (C1) | 75 | 9.8 | Add4 | 26.8 | 180.24 | 1 | 45.0 | BLD1 | 190 | 1.9 | A | C | A |
| Comparative Example 7 | (C1) | 75 | 9.8 | Add5 | 26.8 | 220.35 | 1 | 45.0 | BLD1 | 190 | 2.4 | A | C | A |
| Comparative Example 8 | — | — | 0.0 | Add3 | 26.8 | 689.00 | 3 | 0.0 | BLD1 | 190 | 13.3 | C | A | C |

The results described above indicate that the photoreceptors of the examples have good initial chargeability and an improved charge-retaining property under repeated use.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrophotographic photoreceptor comprising:

a conductive substrate; and a photosensitive layer on the conductive substrate, wherein:

the electrophotographic photoreceptor has an outermost surface layer that contains fluorine-containing resin particles and an antioxidant, the fluorine-containing resin particles contain 0 or more and 30 or less carboxy groups per $10^6$ carbon atoms, and a decrease in weight of the antioxidant when heated at 150° C. for 10 minutes in an air atmosphere is 40 mass % or less.

2. The electrophotographic photoreceptor according to claim 1, wherein the antioxidant has a molecular weight of 240 or more and 350 or less.

3. The electrophotographic photoreceptor according to claim 2, wherein the antioxidant having a molecular weight of 240 or more and 350 or less is a compound having two or more benzene rings in a molecule.

4. The electrophotographic photoreceptor according to claim 1, wherein an amount of the antioxidant contained relative to an amount of the fluorine-containing resin particles is 20 mass % or more and 60 mass % or less.

5. The electrophotographic photoreceptor according to claim 2, wherein an amount of the antioxidant contained relative to an amount of the fluorine-containing resin particles is 20 mass % or more and 60 mass % or less.

6. The electrophotographic photoreceptor according to claim 3, wherein an amount of the antioxidant contained relative to an amount of the fluorine-containing resin particles is 20 mass % or more and 60 mass % or less.

7. The electrophotographic photoreceptor according to claim 4, wherein an amount of the fluorine-containing resin particles relative to the outermost surface layer is 5 mass % or more and 20 mass % or less.

8. The electrophotographic photoreceptor according to claim 5, wherein an amount of the fluorine-containing resin particles relative to the outermost surface layer is 5 mass % or more and 20 mass % or less.

9. The electrophotographic photoreceptor according to claim 6, wherein an amount of the fluorine-containing resin particles relative to the outermost surface layer is 5 mass % or more and 20 mass % or less.

10. An electrophotographic photoreceptor comprising:

a conductive substrate; and a photosensitive layer on the conductive substrate, wherein:

the electrophotographic photoreceptor has an outermost surface layer that contains fluorine-containing resin particles and an antioxidant, the fluorine-containing resin particles contain 0 or more and 30 or less carboxy groups per $10^6$ carbon atoms, and when the electrophotographic photoreceptor is loaded onto a photoreceptor electrical property evaluation apparatus equipped with a charging device, an exposing device, and a charge erasing device, an absolute value of a difference ΔVH between VH1 and VH2 is 5 V or less, where VH1 represents a charge potential of the electrophotographic photoreceptor charged after performing one cycle of a series of charging, exposing, and charge erasing steps under conditions described below, and where VH2 represents a charge potential of the electrophotographic photoreceptor charged after performing one hundred cycles of the same steps under the conditions described below:

(Conditions)

Measurement environment: temperature of 20° C./humidity of 40% RH

Charge potential: +600 V

Exposure dose: 10 mJ/$m^2$

Exposure wavelength: 780 nm

Charge erasing light source: halogen lamp

Charge erasing light wavelength: 600 nm or more and 800 nm or less

Charge erasing light dose: 30 mJ/$m^2$

Rotation rate of photoreceptor: 66.7 rpm.

11. A process cartridge detachably attachable to an image forming apparatus, the process cartridge comprising the electrophotographic photoreceptor according to claim 1.

12. The process cartridge according to claim 11, further comprising:

a cleaning unit that includes a cleaning blade that cleans a surface of the electrophotographic photoreceptor, wherein the cleaning blade has a portion that contacts the electrophotographic photoreceptor, and at least this portion of the cleaning blade is constituted by a member that contains a polyurethane rubber and has an endothermic peak top temperature within a range of 180° C. or more and 220° C. or less in differential scanning calorimetry.

13. An image forming apparatus comprising:

the electrophotographic photoreceptor according to claim 1;

a charging unit that charges a surface of the electrophotographic photoreceptor;

an electrostatic latent image forming unit that forms an electrostatic latent image on the charged surface of the electrophotographic photoreceptor;

a developing unit that develops the electrostatic latent image on the surface of the electrophotographic photoreceptor by using a developer that contains a toner so as to form a toner image; and a transfer unit that transfers the toner image onto a surface of a recording medium.

14. The image forming apparatus according to claim 13, further comprising:

a cleaning unit that includes a cleaning blade that cleans the surface of the electrophotographic photoreceptor, wherein the cleaning blade has a portion that contacts the electrophotographic photoreceptor, and at least this portion of the cleaning blade is constituted by a member that contains a polyurethane rubber and has an endothermic peak top temperature within a range of 180° C. or more and 220° C. or less in differential scanning calorimetry.

15. The electrophotographic photoreceptor according to claim 1, wherein the fluorine-containing resin particles comprise (a) particles of a fluoroolefin homopolymer, and/or (b) particles of a copolymer of two or more monomers which are at least one fluoroolefin monomer and a monomer free of fluorine atoms.

16. The electrophotographic photoreceptor according to claim 15, wherein the fluoroolefin comprises one or more of tetrafluoroethylene (TFE), perfluorovinylether, hexafluoropropylene (HFP), chlorotrifluoroethylene (CTFE), vinylidene fluoride (VdF), trifluoroethylene, and vinyl fluoride.

17. The electrophotographic photoreceptor according to claim 10, wherein the fluorine-containing resin particles comprise (a) particles of a fluoroolefin homopolymer, and/or (b) particles of a copolymer of two or more monomers which are at least one fluoroolefin monomer and a monomer free of fluorine atoms.

18. The electrophotographic photoreceptor according to claim 17, wherein the fluoroolefin comprises one or more of tetrafluoroethylene (TFE), perfluorovinylether, hexafluoropropylene (HFP), chlorotrifluoroethylene (CTFE), vinylidene fluoride (VdF), trifluoroethylene, and vinyl fluoride.

* * * * *